US005609426A

United States Patent [19]

Ito et al.

[11] Patent Number: 5,609,426

[45] Date of Patent: Mar. 11, 1997

[54] PRINTING APPARATUS AND A CONTROL METHOD THEREFOR

[75] Inventors: Yoshikazu Ito; Kazuhisa Aruga, both of Suwa, Japan

[73] Assignee: Seiko Epson Corporation, Tokyo, Japan

[21] Appl. No.: 425,178

[22] Filed: Apr. 20, 1995

[30] Foreign Application Priority Data

Apr. 20, 1994 [JP] Japan ..... 6-081902
Apr. 20, 1994 [JP] Japan ..... 6-081903

[51] Int. Cl.[6] ..... B41J 21/00

[52] U.S. Cl. ..... 400/279; 400/708

[58] Field of Search ..... 400/61, 62, 63, 400/76, 279, 596, 706, 708, 709

[56] References Cited

U.S. PATENT DOCUMENTS

| | | | |
|---|---|---|---|
| 4,277,176 | 7/1981 | Grosvernier | 400/708 |
| 4,960,337 | 10/1990 | Kato et al. | 400/645.1 |
| 5,277,506 | 1/1994 | Oda | 400/279 |
| 5,454,651 | 10/1995 | Tateyama | 400/279 |

*Primary Examiner*—John S. Hilten
*Attorney, Agent, or Firm*—Harold T. Tsiang

[57] ABSTRACT

A printing apparatus capable of using recording media of different widths expands the range of print head movement while limiting the movement of the mask plate, which press the recording media against a platen, to within the area of the recording media, thereby preventing interference between the mask plate and the recording media, as a means of assuring the minimum print head travel required to sufficiently advance the ink ribbon or prevent overheating of the print head. Said printing apparatus comprises an insertion opening to which the recording media is inserted with one side guided by one predetermined side of the insertion opening; a print head for printing on the recording media by means of an ink ribbon disposed between the print head and recording media while moving across the recording media; a masking means moving with the print head between the ink ribbon and recording media across the recording media; a movement range determination means for determining the range of print head movement for printing based on the print data input from a host system; a range limit storing means for storing the limit of print head movement referenced to the one side of the insertion opening within which the mask plate moves within the recording media; and a movement range expansion means for setting an expanded range of print head movement that is greater than the print head movement for printing and within the limit of print head movement.

16 Claims, 12 Drawing Sheets

PRINTING APPARATUS AND A CONTROL METHOD THEREFOR

BACKGROUND OF THE INVENTION

The present invention relates to a printing apparatus such as a dot matrix printer, and relates particularly to a printing apparatus capable of using recording media narrower than the maximum range of print head movement, and to a control method for said printing apparatus.

Printers today are commonly connected as an essential peripheral device to data processing terminals of various types. Printers that can be used for validation printing for printing to cut-sheet so-called validation forms, which are various width of card like recording media having rather high rigidity, or slip printing for printing various types of cut-sheet forms, in addition to journal printing using roll paper, are also commonly available. Printing speeds and print quality have also improved greatly. Compact, light-weight printers offering high functionality and high quality are also available.

It has therefore become necessary to use increasingly compact carriage motors and print heads, and motor torque continues to decline as the operating duration of the dot wires in the print head continues to increase. As motor torque decreases, however, it is necessary to also reduce ribbon travel amount relative to carriage travel amount. When the dot wire operating duration increases, it is necessary to reduce the ribbon speed as a means of preventing the dot wires from catching on the ink ribbon. To prevent the carriage speed from also dropping, however, the ribbon travel to carriage travel ratio must also be reduced. As a result, when the per-line printing area is too short to achieve the required ribbon refresh distance even during logical seeking, the print head must be controlled to move beyond the printing area by an amount equal to the difference between the printing area and the ribbon refresh distance in order to properly refresh the ink ribbon.

To increase the printing speed in wire dot printers, the gap between the platen and print head, i.e., the platen gap, is reduced to shorten the dot wire stroke and thereby improve the response characteristics of the print head.

The ink ribbon is also disposed in this narrow platen gap parallel to the direction of print head travel, and to enable cut-sheet type multiple part printing forms (validation forms) to be inserted smoothly between the ink ribbon and the platen without touching the ink ribbon, a separator called a "mask plate" is disposed between the ink ribbon and the platen. This mask plate is also fastened to the carriage for carrying the print head in a reciprocating motion, and is used to press the recording media to the platen during printing. The mask plate therefore also helps prevent smudging of the recording media by preventing the interference that can easily occur between the recording media and ink ribbon when the recording media is loaded to the specified position and when recording media is advanced, and helps improve print quality by preventing the recording media from lifting off the platen during printing.

Printing noise also increases as a result of the recording media lifting off the platen when printing to cut-sheet type recording media thinner than even validation forms. The mask plate, however, also holds such cut-sheet type recording media against the platen, and is thereby able to further suppress printing noise. As a result, a high functionality, high print quality printing apparatus can be achieved in a relatively simple printing apparatus by using either a mask plate of this type or a similar mechanism that moves with the print head, as does the mask plate, to hold the recording media to the platen.

When the recording media is narrower than the range of print head movement, however, the mask plate may travel to a position outside the recording media, i.e., to an area where there is no recording media, if the range of print head movement is increased to assure a sufficient ribbon refresh distance or to prevent coil damage when the print head heats up as a result of the conventional printer control method described above. When the print head is then moved back within the boundaries of the recording media, i.e., within the printing area of the paper, the part of the mask plate pressing the recording media against the platen commonly interferes with the edge of the recording media, resulting in damage to the recording media, interference with print head movement, and/or printing errors.

When using a variety of recording media, including cut-sheet forms, the length and width of the forms will vary, and once the mask plate moves past the edges of the recording media, the recording media can easily lilt off the platen, leading quickly to the interference problems described above. As a result, when a mask plate or similar pressing mechanism is used, it is possible to achieve high quality printing to a variety of print media, but the problems described above will also occur when printing to narrow recording media.

Printers conventionally use a "logical seeking" control method whereby the print head is moved the shortest distance between the current print head position and the printing start position, and prints by moving only through the area printed to, as a means of achieving high speed printing.

With wire dot printers and other printers which print using an ink ribbon, however, an ink ribbon refreshing operation whereby the ink ribbon is advanced a predetermined amount at a regular interval is required to sustain high quality printing. While it is possible to provide a motor only for driving the ink ribbon at a regular interval, the most common method applied in compact printers is a mechanism whereby the ink ribbon is advanced using the drive force of the carriage motor in conjunction with the movement of the carriage on which the print head is mounted.

Advancing the ink ribbon with this type of mechanism, however, greatly increases the load on the carriage motor, or uses gears with a high speed reducing ratio to reduce the load on the motor and prevent the print head from jamming. As a result, the print head must travel a relatively long distance (i.e., the ribbon refresh distance ) to advance the ink ribbon far enough to refresh the ribbon.

To reduce the frequency of occurring of the case in which the printing area in one line is shorter than the required ribbon refresh distance, this conventional logical seeking control method requires the low speed reduction ratio or the high output torque of the carriage motor, thus providing a means of achieving a sufficient ribbon refresh distance with a shorter distance carriage traveling.

In a wire dot printer, a coil for driving the dot wires is housed in the print head. To prevent heat damage to this coil, or to prevent operating problems caused by wire heating, and thus maintain print quality, a control method that changes the printing frequency per trait time (the print duty) is used. This method typically uses a thermistor or other temperature detecting means to detect the internal temperature rise of the coil or print head, or a means for detecting the coil resistance instead. When the print head temperature is determined to have exceeded a predetermined threshold value, conventional logical seeking control is adjusted to reduce the print duty, and the print head is controlled to travel from one side to the other side of the printing area. To further suppress the temperature rise, "interval drive" is used. With interval drive, movement of the print head is stopped for a predetermined period at one side of the printing area.

SUMMARY OF THE INVENTION

Therefore, the object of the present invention is to provide a printing apparatus whereby high quality printing to a variety of print media of different widths is possible without the problems described above occurring. More specifically, the object of the present invention is to provide a printing apparatus, and a control method therefor, whereby the aforementioned printing problems can be prevented and high quality printing can be achieved in a compact printing apparatus used for various purposes by assuring the ink ribbon is advanced sufficiently to refresh the ribbon while simultaneously preventing damage to the print head without interference between the recording media pressing mechanism and the recording media even when narrow recording media is used.

To achieve the aforementioned object, recording media loaded to a printing apparatus according to the present invention is inserted with one edge of the recording media aligned to one side of the printing apparatus, and the range of print head movement is expanded referenced to this one side of the printing apparatus in a manner whereby the masking means does not go beyond the recording media edge even with recording media of different widths, including validation forms and slip forms.

More specifically, a printing apparatus according to the present invention capable of printing to at least smaller width of recording media than the recording area thereof having a print head for printing to the recording media by means of an ink ribbon disposed between the print head and recording media while moving across the recording media and a print head movement range determination means for determining the range of print head movement in accordance with print data input from a host system comprises: an insertion opening to which the recording media is inserted with one side of the recording media guided by one predetermined side of said insertion opening; a masking means disposed between the ink ribbon and recording media for pressing the recording media against a platen while moving with the print head across the recording media; a range limit storing means for storing a range limit of print head movement which is smaller than the furthest printing area referenced to said predetermined side of the insertion opening, and within which the mask plate moves on the recording media; and a print head movement range expansion means for expanding the range of print head movement within the range limit of print head movement.

With a printing apparatus thus described, it is more effective that the range limit of print head movement is set to be the minimum limit of print head movement determined according to the width of the smallest recording media that is allowed to be used in the printing apparatus. Alternatively, it is also effective that a paper width determination means is provided for determining the width of the inserted recording media based on the information input from the host system, and setting the range limit of print head movement according to the paper width obtained thereby.

A printing apparatus according to the present invention may further comprise a movement range comparing means for comparing the range of print head movement with the range limit of print head movement stored in the range limit storing means; and a range limit updating means for setting a wider one of the range and range limit of print head movement to the range limit storing means as the new limit of print head movement.

By further comprising a recording media detector for detecting the presence of recording media, the range limit updating means can set the predetermined initial range limit of print head movement to the range limit storing means based on the change in the output from the recording media detector.

By means of the invention thus comprised, it is possible to expand the range of print head movement to assure the ink ribbon is advanced a sufficient amount.

Specifically, a printing apparatus according to the present invention further comprises an ink ribbon advancing means for advancing the ink ribbon in conjunction with movement of the print head; a movement comparing means for comparing the amount of print head movement with the predetermined amount of print head movement required to sufficiently advance the ink ribbon; and is characterized by the movement range expansion means expanding the range of print head movement to obtain said predetermined amount of print head movement when the amount of print head movement is less than said predetermined amount of print head movement.

In this case, the printing apparatus may further comprise a direction evaluation means for determining the direction of print head movement based on the range of print head movement and the position of the print head; and be characterized by the ink ribbon advancing means advancing the ink ribbon only when the direction determined by the direction evaluation means is one direction, and the movement range expansion means expanding the range of print head movement only when the direction determined by the direction evaluation means is said one direction.

The characteristics of the present invention as described above can also be applied to the print head cooling operation applied when the print head temperature rises.

Specifically, a printing apparatus according to the present invention may further comprise: a temperature detecting means for detecting the temperature of the print head; and a temperature rise detecting means for detecting when the print head temperature exceeds a predetermined threshold value; and is characterized by the movement range expansion means expanding the range of print head movement when the temperature rise is detected by the temperature rise detecting means.

In this case, the range of print head movement can be expanded to the range limit of print head movement by the movement range expansion means.

The present invention can also be expressed as a control method for a printing apparatus. Specifically, a control method according to the present invention for a printing apparatus capable of printing to at least smaller width of recording media than the recording area thereof having a print head for printing to the recording media by means of an ink ribbon disposed between the print head and recording media while moving across the recording media and a print head movement range determination means for determining the range of print head movement in accordance with print data input from a host system comprising: an insertion opening to which the recording media is inserted with one side guided by one predetermined side of said insertion opening; a masking means disposed between the ink ribbon and recording media for pressing the recording media against a platen while moving with the print head across the recording media; comprises: a movement range determination process for determining the range of print head movement based on the print data; a range limit storing process for storing the range limit of print head movement referenced to one side of the insertion opening, said range limit corresponding to the width of the narrowest recording media allowed to be used in said printing apparatus; a movement range comparing process for comparing the range with the range limit of print head movement; a range limit updating process for storing the wider one of the range and the range limit of print head movement based on the results of the movement range comparing process as the new limit of print head movement replacing the range limit previously stored in the range limit storing process; and a movement range expansion process for setting an expanded range of print head movement within the limit of possible print head movement.

This control method may further comprise a recording media detecting process for detecting the presence of recording media; and be characterized by controlling the range limit storing process based on the change in the result of the recording media detecting process.

This control method may further comprise a paper width determination process for determining the width of the inserted recording media based on the information input from the host system; and be characterized by the range limit storing process storing the limit of print head movement according to the paper width obtained by the paper width determination process.

This control method for a printing apparatus according to the present invention can also be applied to expand the range of print head movement as a means of assuring the ink ribbon is advanced to sufficiently refresh the ink ribbon.

Specifically, a control method according to the present invention may further comprise: an ink ribbon advancing process for advancing the ink ribbon in conjunction with movement of the print head; and a movement amount comparing process for comparing an amount of print head movement with a predetermined amount of print head movement required to sufficiently advance the ink ribbon; and the movement range expansion process expanding the range of print head movement to obtain said predetermined amount of print head movement when the amount of print head movement is less than said predetermined amount of print head movement.

This control method for a printing apparatus according to the present invention can also be applied to cool the print head when the print head temperature rises.

Specifically, a control method according to the present invention may further comprise: a temperature detecting process for detecting the temperature of the print head; and a temperature rise detecting process for detecting when the print head temperature exceeds a predetermined threshold value; and the movement range expansion process expanding the range of print head movement when the temperature rise is detected in the temperature rise detecting process.

The operation of the present invention is described below.

The recording media insertion opening is comprised in a manner whereby the recording media inserted thereto is inserted with one edge of the recording media guided by one predetermined side of the insertion opening. The print head prints to the recording media while moving across the recording media by means of an ink ribbon disposed between the print head and recording media. The masking means disposed to prevent accidental contact between the ink ribbon and to press the recording media against the platen and recording media moves with the print head across the recording media. The range of print head movement is determined according to the print data input from the host system. The allowable range of print head movement is stored in the range limit storing means as the limit of print head movement referenced to the predetermined side of the insertion opening against which the one side of the recording media is guided during loading thereof.

When the printing range of the print head must be expanded, the movement range expansion means defines an "expanded range of print head movement" that is wider than the range and within the defined limit of print head movement. As a result, the print head can expand the range of print head movement within the limit from the one side of the recording media, i.e., within the defined limit of print head movement. By thus setting the limit of print head movement according to the width of the loaded recording media, movement of the masking means beyond the area of the recording media can be prevented.

If the limit of print head movement is the limit defined for the narrowest recording media that is allowed to be used in the printing apparatus, it is possible to prevent movement of the masking means outside the area of the recording media irrespective of the width of the recording media actually loaded into the printing apparatus. By further providing a paper width determination means, it is also possible to determine the width of the inserted recording media, and to set the limit of print head movement according to the paper width thus obtained.

The movement range comparing means of the invention compares the range of print head movement with the range limit of print head movement stored in the range limit storing means, and when the printing range is greater than the range limit, the range limit updating means sets that printing range as the new range limit of print head movement to the range limit storing means. This makes it possible to expand the range limit of print head movement to the farthest point to which printing is required, i.e., the range limit can be expanded to the farthest point from the reference position to which printing is required.

In this case, when the presence of recording media is detected by the recording media detector, or when printing to the recording media is completed, or when the next recording media is inserted, the range limit updating means can initialize the range limit, i.e., can execute the process whereby the predetermined range limit of print head movement is stored to the range limit storing means. As a result, the masking means can be reliably prevented from moving outside the area of the recording media even when recording media of different widths is successively loaded to the printing apparatus.

The operation whereby the range of print head movement is expanded to assure the ink ribbon is advanced sufficiently to refresh the ink ribbon is described briefly below.

The ink ribbon advancing means is comprised to advance the ink ribbon in conjunction with movement of the print head. The movement comparing means compares the distance from one side to the other side of the range of print head movement with a predetermined amount of print head movement required to sufficiently advance the ink ribbon. If the amount of print head movement is less than this predetermined amount of print head movement, the movement range expansion means expands the range of print head movement to obtain said predetermined amount of print head movement. It will be obvious that the range of print head movement after expansion will still not exceed the range limit.

When the ink ribbon advancing means is comprised to advance the ink ribbon only when the print head is moving in one direction, the direction of print head movement can be determined based on the range of print head movement and the position of the print head by a direction evaluation means. In this case, the movement range expansion means may be comprised to expand the range of print head movement only when the direction in which the ink ribbon is advanced is said one direction.

The operation of the present invention when applied to cool the print head when the print head temperature rises is described briefly below.

In this case, the printing apparatus further comprises a temperature detecting means for detecting the temperature of the print head, and a temperature rise detecting means for detecting when the print head temperature exceeds a predetermined threshold value based on the output from the temperature detecting means. When the print head temperature is thus determined to exceed the threshold value, the movement range expansion means expands the range of print head movement. The maximum print head cooling effect can be obtained by the movement range expansion means expanding the range of print head movement to equal the range limit.

DESCRIPTION OF THE PREFERRED EMBODIMENTS

Figure 1:
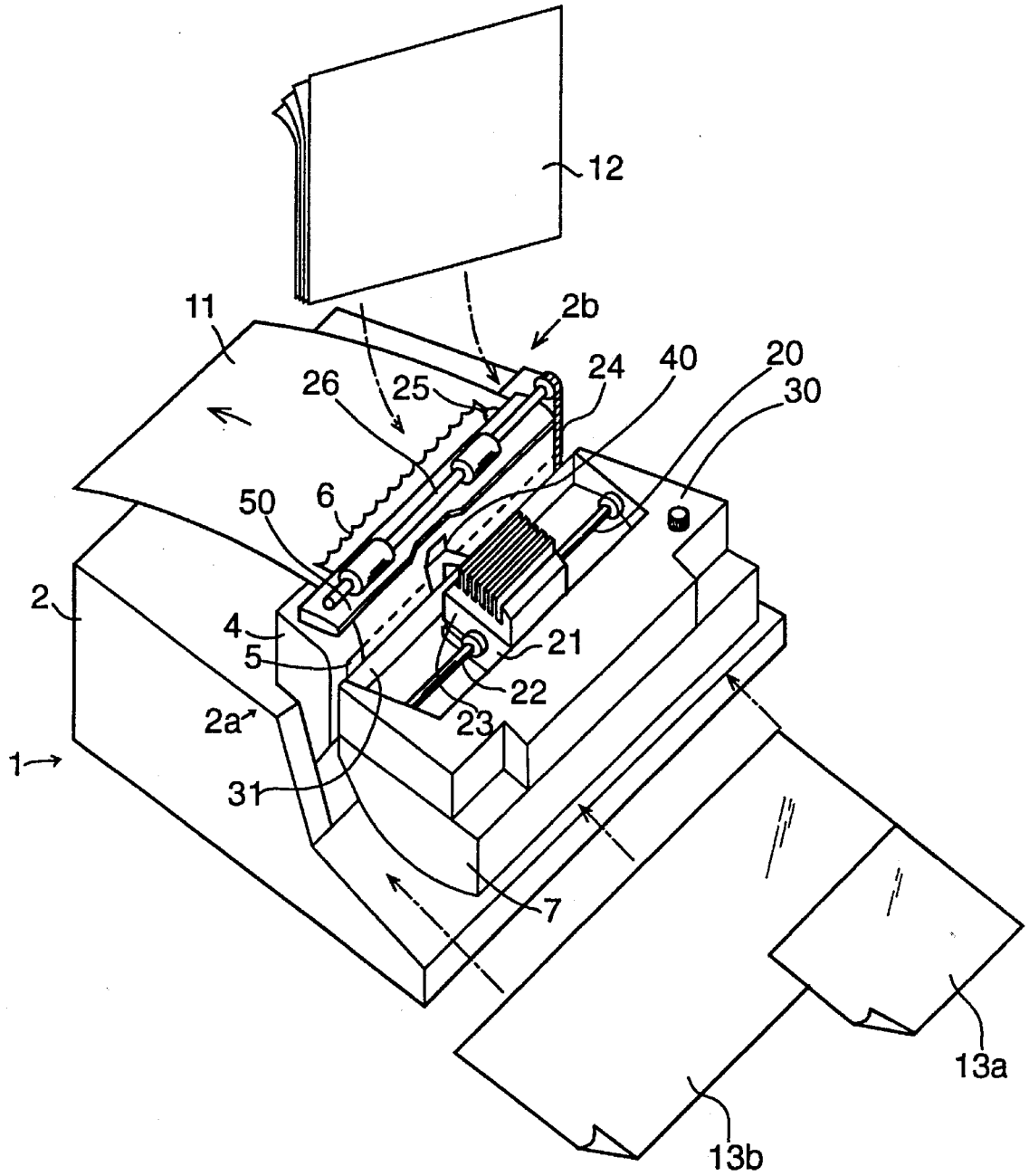
FIG. 1 is a perspective view of a printer according to the preferred embodiment of the present invention.

The preferred embodiments of the present invention are described below with reference to the accompanying figures, of which FIG. 1 is a perspective view of a printer 1 according to the preferred embodiment of the present invention.

Referring to FIG. 1, printer 1 stores roll paper 11 in one end of a solid-rectangle shaped body 2, which extends slightly in the direction in which roll paper 11 is transported. A carriage unit 22 moving in the direction crosswise to roll paper 11 along carriage guide shaft 20 is disposed to the end of body 2 opposite the section in which roll paper 11 is stored.

This carriage unit 22 is supported by carriage guide shaft 20, and is driven by means of a timing belt not shown in the figures. The head unit 21 is mounted on this carriage unit 22. Carriage unit 22 is movable through the printing area along carriage guide shaft 20. Print head 23 for dot matrix printing projects from head unit 21 at a position facing roll paper 11.

Ribbon case 30 is installed behind head unit 21, i.e., on the side of head unit 21 opposite roll paper 11, and comprises side arms projecting toward roll paper 11 outside the range of print head 23 movement. Ink ribbon 31 loops from within ribbon case 30 between the side arms thereof, and crosses roll paper 11 parallel to carriage guide shaft 20. Said ink ribbon 31 passes between print head 23 and roll paper 11, and travels in the direction of print head 23 movement. Ink ribbon 31 is advanced in conjunction to the movement of print head 23 by a mechanism internal to the printer such that the unused (or used only few times) portion of ink ribbon 31 are struck by the wire dots of print head 23 to print with good definition to the recording media. The mechanism whereby ink ribbon 31 is advanced in relation to print head 23 is described in detail below.

The printer 1 of this embodiment further comprises a paper guide 4 long in the crosswise direction of body 2 and facing head unit 21 with roll paper 11 held there between. Said paper guide 4 has a U-shaped vertical cross section at the approximate center of which is formed an opening through which platen 5 projects to press the recording media against a mask plate 40 described below. If the recording media is set to the surface side of paper guide 4 facing print head 23, the back of the recording media can be reliably supported because platen 5 projects from the back of the recording media during printing.

A mask plate 40 is disposed between ink ribbon 31 and roll paper 11 and in front of print head 23 from carriage unit 22, i.e., in the platen gap between print head 23 and platen 5. Said mask plate 40 is a thin, flexible plate member, the bottom end of which is fastened to carriage unit 22. The top of mask plate 40 extends toward platen 5, and functions to press roll paper 11 or other recording media loaded between mask plate 40 and platen 5 against platen 5. By thus pressing the recording media firmly against platen 5 by means of mask plate 40, the platen gap can be reduced while still preventing interference between the recording media and ink ribbon 31, thereby making high quality printing possible. The recording media is also prevented from lifting off platen 5 because the recording media is pressed against platen 5 by mask plate 40, and the noise caused by recording media vibrations can therefore be prevented.

Mask guide 41 contacting the leading edge of mask plate 40, and cutter 6 for cutting the roll paper, are provided above paper guide 4 disposed from one side **2*a* to the other side 2*b* of body 2. Roller shaft 26 is also disposed from one side 2*a* to the other side 2*b* of body 2 above mask guide 41, and is fitted with plural paper feed rollers 25. Roller shaft 26 is connected to the paper transport feed motor (not shown in the figures) by means of belt 24 disposed at the right side 2*b* of body 2 as viewed in FIG. 1**.

In addition to roll paper 11, printer 1 of the present invention can also print to cut-sheet type recording media such as validation forms 12, and slip forms 13*a* and 13*b* of various widths. Validation forms 12 are typically multiple part printing forms used for printing authorized receipts and similar documents. In printer 1 according to the present embodiment, validation forms 12 are inserted from the area of paper transport roller 25 at the top of printer 1 with the right edge of the form aligned to the right side 2*b* of the printer.

Slip forms 13 are inserted from the gap between bottom paper guide 7 and body 2, guided by curved bottom paper guide 7 disposed below head unit 21. Slip forms 13 may vary in width from wide forms that are wider than body 2 and therefore have the left side thereof remaining outside the printer while printing, to narrow forms that are much narrower than the maximum printable width of the printer.

It is important to note that printer 1 according to the present invention is designed for printing even to slip forms 13 of the narrowest possible width. Slip forms 13 of all widths are also inserted aligned to the right side of printer 1, as are validation forms 12 as described above, for loading to platen 5.

Printing to any of the recording media loaded into printer 1 is controlled according to the print data input from the personal computer or other upstream device.

Figure 2:
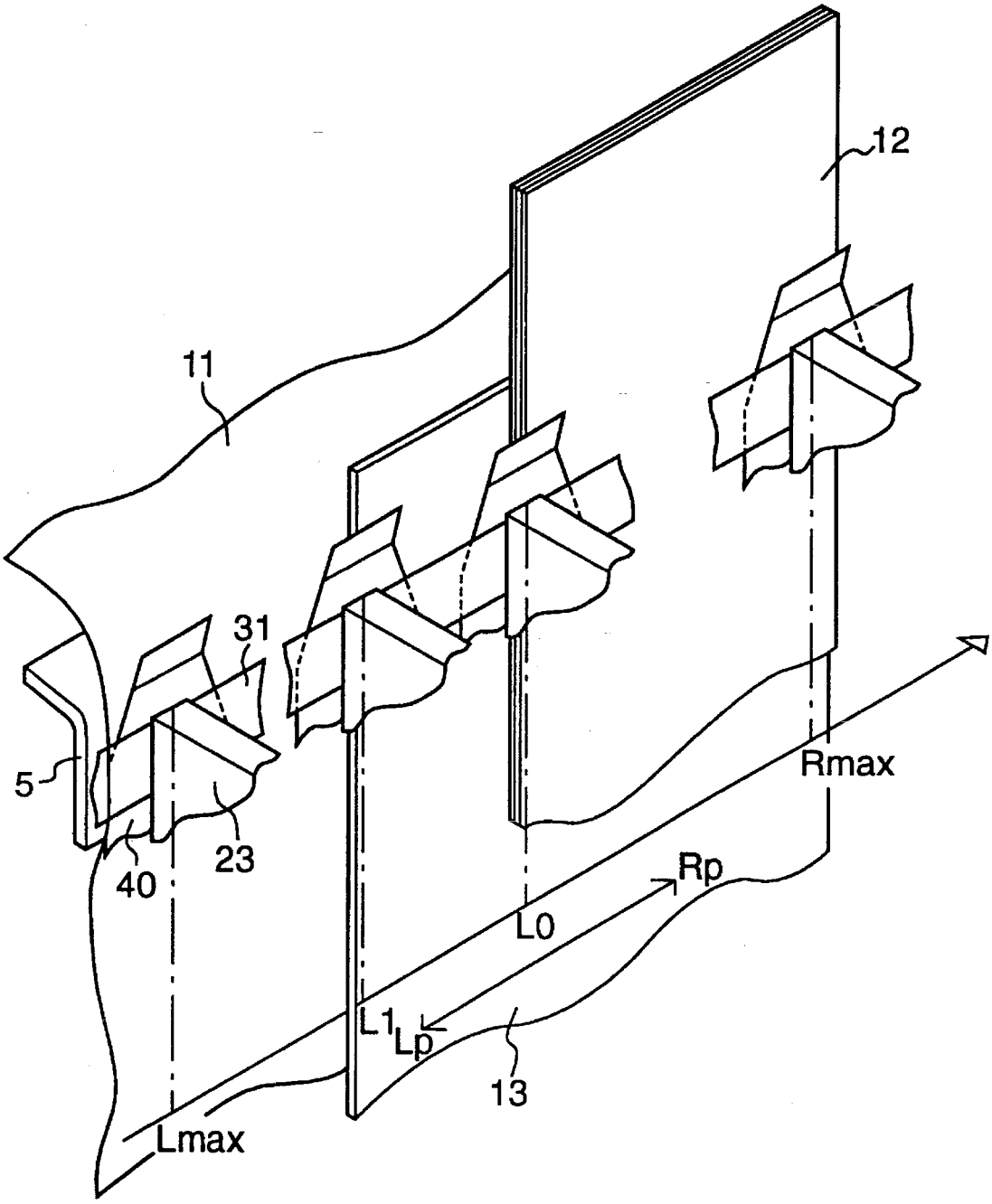
FIG. 2 illustrates the relationship between the print head and recording media when recording media of different widths is loaded into the printer shown in FIG. 1.

Movement of print head 23 across the surface of the recording media loaded to printer 1 according to this first embodiment is illustrated in FIG. 2. As described above, slip forms 13 of various widths can be used in a printer according to this first embodiment, and slip forms 13 may vary in width from forms that are relatively narrow to forms that are wider than roll paper 11. To simplify the following description, a narrow validation form 12 and slip forms 13 of an intermediate width are shown in FIG. 2.

In a printer 1 thus comprised, roll paper 11, validation forms 12, or other slip forms 13 are loaded to printer 1 and are pressed to platen 5 by mask plate 40 while print head 23 moves across the surface of the recording media. The maximum range of print head 23 movement is from $L_{max}$ at the left side of printer 1 to $R_{max}$ at the right side, and this range is the maximum printable area. Note that the maximum printable area is narrower than the width of roll paper 11. The smallest range of print head 23 movement is the area from left side LO to $R_{max}$. This smallest range is within the width of the narrowest validation forms 12 used. As also described above, ink ribbon 31 is advanced in conjunction with the movement of print head 23, and this smallest range is designed large enough to assure ink ribbon 31 is advanced sufficiently.

Figure 3:
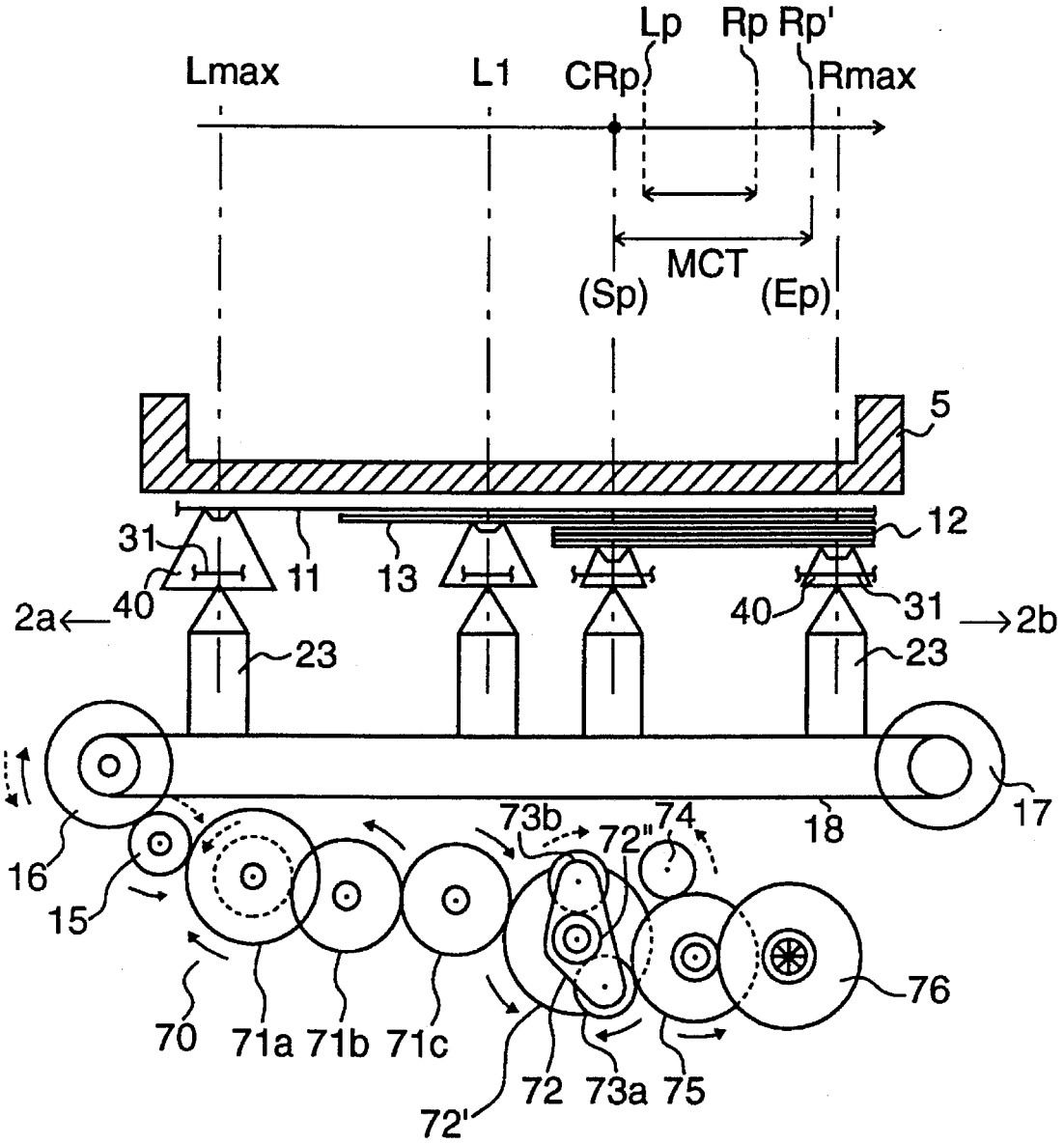
FIG. 3 shows the ink ribbon transport assembly of the printer shown in FIG. 1.

FIG. 3 illustrates a schematic view of assembly 70 for advancing ink ribbon 31 in conjunction with the movement of print head 23, and the operation of assembly 70. As also described above, print head 23 is provided on a carriage unit, which is driven by a timing belt 18.

Timing belt 18 connects pulley gear 16 disposed at the right side 2*a* of printer 1 with pulley 17 disposed at the left side 2*b* of printer 1. Pulley gear 16 is engaged with carriage motor 15, and drives print head 23 by means of timing belt 18. Carriage motor 15 is also engaged with ink ribbon transport assembly 70, and drives the gear disposed to rocker 72 by means of idler gears 71*a*, 71*b*, and 71*c*. Rocker 72 comprises two rocker gears 73*a* and 73*b* in a manner whereby the rotation of rocker 72 driven according to the rotational direction of carriage motor 15 causes either rocker gear 73*a* or rocker gear 73*b* to drive ribbon drive shaft 76 by means of idler gears 74 and 75.

For example, when carriage motor 15 rotates to the right (clockwise) and print head 23 is driven to the left side 2*a*, rocker gear 73*b* drives idler gears 74 and 75 to rotate ribbon drive shaft 76 left (counterclockwise), thereby advancing ink ribbon 31 between print head 23 and the recording media. When carriage motor 15 rotates to the left (counterclockwise) and print head 23 is driven to the right side 2*b*, rocker gear 73*a* drives idler gear 75 to rotate ribbon drive shaft 76 left (counterclockwise). As a result, a printer according to the present invention advances ink ribbon 31 in only one direction whether print head 23 moves to the right or the left, and thereby assures high quality printing.

It is important to note that ribbon drive shaft 76 is not rotated by carriage motor 15 while the engagement of rocker gears is switching when the rotational direction of carriage motor 15 is reversed. In other words, an idle movement of carriage unit 22, in which carriage unit 22 moves without advancing ink ribbon 31, appears when carriage unit 22 changes its moving direction.

To prevent overloading carriage motor 15 and thus inhibiting print head 23 movement while advancing print head 23, ink ribbon transport assembly 70 uses plural idler gears to achieve a high speed reduction ratio. It is also necessary to drive ribbon drive shaft 76 a predetermined angle of rotation even after passing the plural idler gears in order to advance the ink ribbon sufficiently, because it is necessary to perform the ink ribbon refreshment every printing line to assure a consistent printing density. This means that carriage motor 15 must rotate through a significant angle of rotation and move carriage unit 22 as much as the predetermined range (the 'minimum carriage travel' or MCT in this embodiment) in order to refresh ink ribbon 31. Note that MCT includes above mentioned carriage idle movement occurs when switching the moving direction.

In the logical seeking of the present embodiment, a pre-seek for moving carriage unit 22 from the present place to the printing start position is sometimes executed before printing. In this case, the moving direction of carriage unit 22 is reversed at the printing start position as described later and the carriage idle movement occurs here. Though the carriage movement amount equals to the sum of the printing range and the pre-seek amount, the latter does not significantly contribute to the ink ribbon advancement because of the carriage idle movement at the turning point. Therefore, in the present embodiments, the pre-seek amount is neglected in the calculations of the ink ribbon advancement.

In a printing apparatus printing only to roll paper 11, mask plate 40 will not move outside the area of the recording media even when print head 23 is moved through the full maximum printable area, and may therefore be controlled to move within that area, i.e., between $L_{max}$ and $R_{max}$, and within a range exceeding the minimum required travel MCT. However, when recording media of different widths is used as in the printer 1 of this embodiment, the side of mask plate 40 may interfere with the edge of the recording media, and may therefore damage the recording media, when mask plate 40 moves past the edge of the recording media and then moves to return to the recording media.

For example, if validation forms 12 are used and no consideration is given to the width of the recording media, mask plate 40 may move beyond the outside edge of validation forms 12 (point L1 in FIG. 3) in order to maintain the minimum required travel MCT. When print head 23 is then moved back to within the area of the validation form to print the next line to the form, mask plate 40, which is still pressed against platen 5, moves with print head 23 to the right. Because mask plate 40 is flexible and presses the recording media in the direction of platen 5, the gap between mask plate 40 and platen 5 becomes essentially zero once mask plate 40 separates from validation form 12 to the left side. As a result, when mask plate 40 returns to the right, the side of mask plate 40 and/or the opening in the center thereof through which the dot wires of print head 23 pass will very likely interfere with the left edge of validation form 12. With this type of control, therefore, there is a strong possibility that such problems as validation forms 12 being damaged, or print head 23 becoming jammed and printing being therefore disabled, will occur.

Multiple part forms such as validation forms 12 can be printed with well-defined characters, interference between validation forms 12 and ink ribbon 31 can be prevented, and noise caused by validation forms 12 lifting off the platen and vibrating, can be reduced because mask plate 40 holds validation forms 12 pressed firmly against platen 5. When mask plate 40 moves off validation forms 12 and the pressure holding validation forms 12 against platen 5 is thereby released, the thickness of the forms and the removal of this pressure allows validation forms 12 to lift from platen 5, resulting in the problems described above when print head 23 moves back toward validation forms 12.

Therefore, when the area to which printing is required is narrower than the minimum required travel MCT, the range of print head 23 movement is expanded in a printer 1 according to the present embodiment while limiting the movement of print head 23 to the area within the boundaries of the narrowest validation forms 12 or other recording media used.

Figure 4:
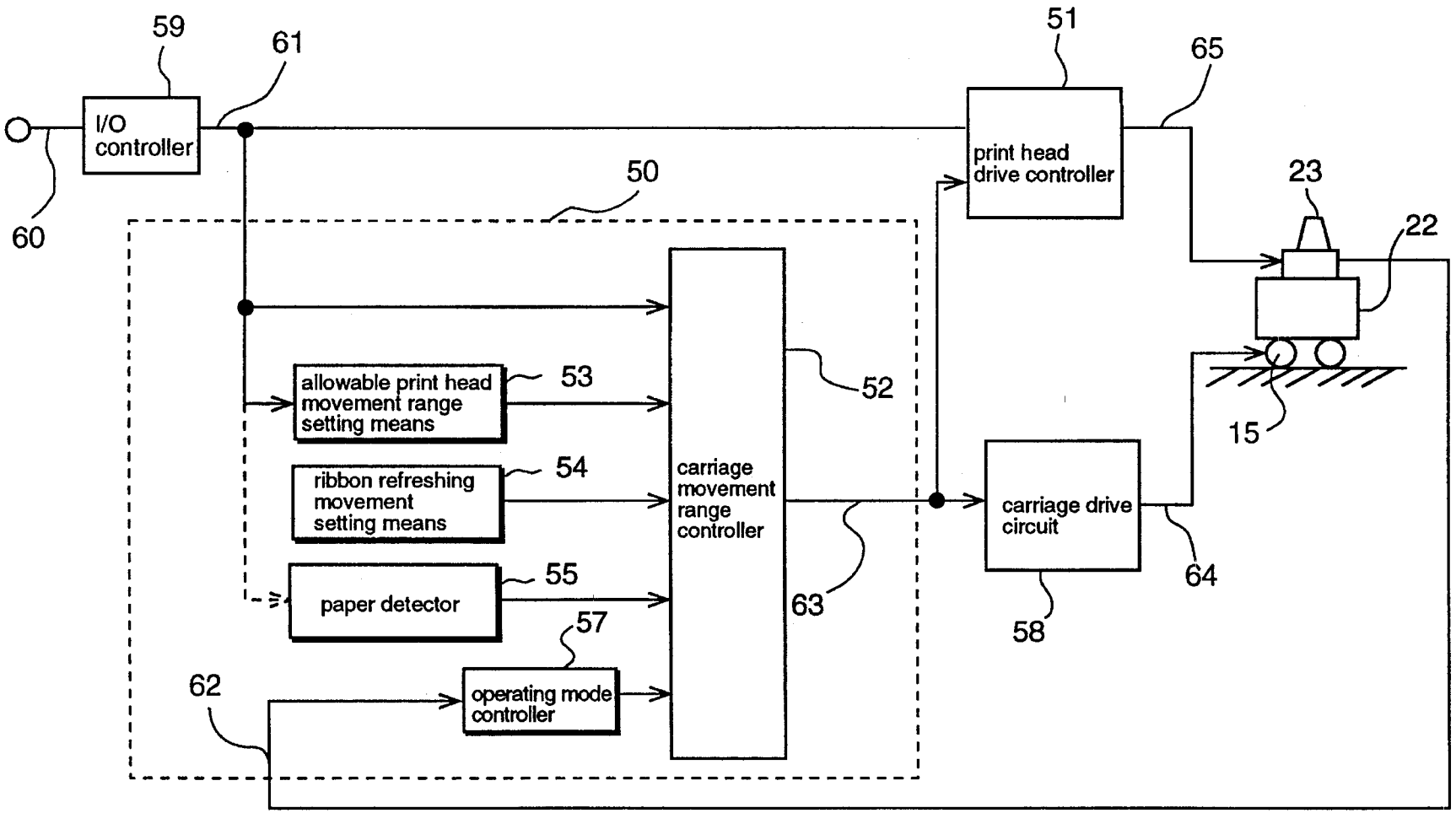
FIG. 4 is a block diagram used to describe the control method of a printer according to the present invention.

FIG. 4 is a block diagram of a printer 1 achieving this type of control according to the present embodiment. Said printer 1 receives external data 60, including print data and commands for controlling the printing process, from an external device, such as a personal computer or point-of-sale terminal, and controls printer operation based on the input external data 60. Input/output (I/O) controller 59 receives and analyzes external data 60 input thereto from an external device, and outputs internal data 61 comprising the specific data and commands to carriage controller 50 and print head drive controller 51. Carriage controller 50 controls the position and speed of the carriage, and print head drive controller 51 controls print head drive for forming characters, images, and other printed data on the recording media.

Carriage control signal 63 generated by carriage controller 50 is output to print head drive controller 51 and carriage drive circuit 58 to execute the actual printing process. More specifically, carriage drive circuit 58 outputs carriage drive signal 64 to carriage motor 15 based on carriage control signal 63 to drive carriage motor 15, and thereby move carriage unit 22 to the specified location. Also based on carriage control signal 63, print head drive controller 51 obtains the position information of print head 23 mounted on carriage unit 22, and forms the specified characters, images, and other printed data on the recording media by outputting to print head 23 a print head control signal 65 based on the print head 23 position information.

The structure of carriage controller 50, which is an essential component to the present invention, is described below.

Carriage movement range controller 52 determines the movement range of carriage unit 22 and generates carriage control signal 63 based on the information input thereto, specifically: internal data 61 comprising the information identifying the position to be printed; information from the allowable print head movement range setting means 53, which sets the range of movement within which mask plate 40 can move without interfering with the recording media; and information from ribbon refreshing movement setting means 54, which sets the minimum required carriage unit travel MCT required to refresh the ink ribbon.

Based on this supplied information, carriage movement range controller 52 sets the range of carriage unit 22 movement required to print the print data and assure the ink ribbon is advanced far enough to refresh the ink ribbon while limiting the range of carriage unit 22 movement to within the area in which interference between mask plate 40 and the recording media does not occur.

By inputting internal data 61 to allowable print head movement range setting means 53, it is possible to expand the range of allowable movement based on the history of the specified printing position. More specifically, considering the high probability that the external device will generate the print commands based on the size of the recording media used, it can be assumed that the recording media will exist wherever printing is specified, and the range of allowable movement can therefore be expanded to at least the limit of the printing area specified for the current print data. In this embodiment, this expanded range of allowable movement is reset to the default initialization range after the printing process for each recording media is completed. More specifically, allowable print head movement range setting means 53 reinitializes the range of allowable movement based on a "no paper" signal output from a paper detector not shown in the figures.

Also input to carriage movement range controller 52 is the operating mode information from operating mode controller 57, which determines the operating mode of printer 1 according to the temperature rise resulting from heat generated by print head 23. When operating mode controller 57 selects the cooling mode whereby the print head drive duty is reduced, carriage movement range controller 52 sets the maximum area in which interference between mask plate 40 and the recording media will not occur as the range of allowable movement by means of the method described below. Because the range of print head movement will thus be maximized to include an area in which the print head does not print, the print head drive duty will be suppressed relative to the normal operating mode, and the print head will therefore cool.

The temperature rise of print head 23 is detected as described below for determining the operating mode. Temperature detection information 62 is obtained as a voltage corresponding to the resistance of a thermistor (not shown in the figures) provided in the print head, and is input to operating mode controller 57. Said operating mode controller 57 converts the input voltage value to a digital value by means of an analog/digital (A/D)converter, and then compares this converted digital value with a predetermined value to detect whether the temperature of print head 23 has risen to a predetermined threshold value.

A paper detector 55 for determining whether the recording media is roll paper or not is also provided, and the data output therefrom makes it possible to achieve even more efficient carriage control. Specifically, the print head drive duty can be further reduced, and an even greater cooling effect can therefore be obtained, by increasing the range of allowable movement to the maximum limit of the printing apparatus when the recording media is roll paper by removing the limit to the range of allowable movement set by allowable print head movement range setting means 53. In this embodiment, paper detector 55 identifies the type of recording media based on the information relating to the recording media contained in internal data 61.

Figure 5:
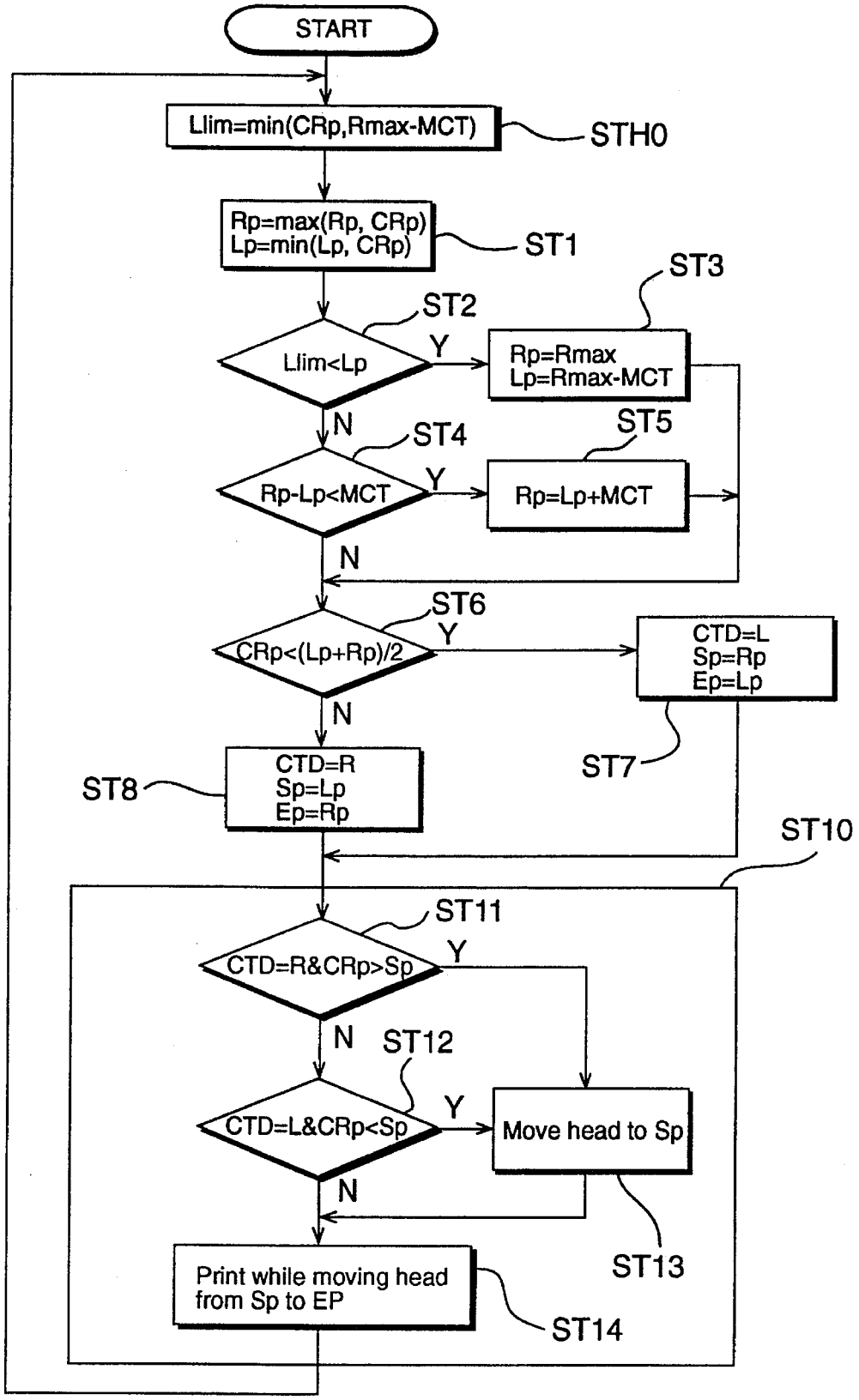
FIG. 5 is a flow chart of a first control method associated with ink ribbon advancement in a printer according to the present invention.

FIG. 5 is a flow chart of the procedure controlling determination of the print head movement range in printer 1 according to the present embodiment. It is to be noted that in the following description the position of print head 23 and the range of print head movement are described using a coordinate system of values increasing from $L_{max}$ at the left edge of the maximum printable area to $R_{max}$ at the right edge thereof (where $L_{max}$ represents the left edge of this range and $R_{max}$ represents the right edge).

In step STH0, the left allowable position Llim is set to the minimum of current position CRp and $R_{max}$–MCT which is a position away from the right most position $R_{max}$ by munimum required travel MCT. Then in step ST1, the right edge Rp and left edge Lp of the area through which print head 23 moves are initialized to the fight and left edges, respectively, of the area to be printed based on internal data 61, which includes the print data. The values of Rp and the current position CRp at which print head 23 is stopped are then compared, and the position nearest $R_{max}$ is defined as the right edge Rp of the range of print head movement. Similarly, the values of Lp and the current position CRp at which print head 23 is stopped are then compared, and the position nearest $L_{max}$ is defined as the left edge Lp of the range of print head movement. As a result, the range between these right edge Rp and left edge Lp values is the range through which print head 23 moves during the actual printing process.

In step ST2, it is determined whether the distance between left edge Lp of the movement range and $R_{max}$ is greater than the minimum required travel MCT for ink ribbon refreshing. By using Llim the equation for the judgment can be written as;

Llim<Lp

Note that if CRp is nearer to Lmax than or the same as Rmax–MCT, Lp is equal to or less than Llim because Llim is equal to CRp and Lp is equal to or less than CRp. Plus, if CRp is further to Lmax than Rmax–MCT and Lp(law data before step ST1) is tha same as or further to Lmax than CRp, Lp is greater than Llim because Lp is equal to CRp and Him is equal to Rmax–MCT which is less than CRp. Therefore, if the equation is true, Lp always positions within MCT from Rmax resulting MCT cannot be achieved between Lp and Rmax.

If the equation is true, the right edge Rp of the movement range is reset to equal $R_{max}$ and the left edge Lp is reset to the position separated by the minimum required travel MCT from $R_{max}$ (step ST3).

It is to be noted that printer 1 according to this embodiment is configured to accept recording media of any width inserted with the right edge of the recording media aligned to the right side of the insertion opening. In addition, the minimum required travel MCT is predetermined according to the width of the narrowest validation forms 12 that will be inserted. Specifically, if the position at which mask plate 40 travels closest to $L_{max}$ when carriage unit 22 is moved from $R_{max}$ toward $L_{max}$ without moving beyond the left edge of validation form 12 is defined as MPW when the narrowest possible validation form 12 is inserted with the right edge thereof aligned to the right side of the insertion opening, the following equation will be true.

$$R_{max}\text{–MPW} \geqq \text{MCT} \quad (1)$$

As a result, if left edge Lp is set to the position separated from $R_{max}$ by the minimum required travel MCT, mask plate 40 will not move outside the area of the narrowest recording media as print head 23 moves between $R_{max}$ and left edge Lp. As a result, interference between the mask plate and the recording media, and other problems as described above can be reliably prevented. In addition, the range of print head 23 movement is equal to the minimum required travel MCT, the ink ribbon can therefore be reliably advanced, and quality printing can be accomplished.

When the minimum required travel MCT can be assured between $R_{max}$ and the left edge Lp of the print head movement range derived from the required printing area and the stop position of print head 23, it is determined in step ST4 whether the minimum required travel MCT can be obtained in the range of print head movement. If the range of print head movement is shorter than the minimum required travel MCT, the right edge Rp value of the print head movement range is reset to the value of the minimum required travel MCT greater than the left edge Lp value (step ST5). Because print head 23 travels at least the minimum required travel MCT as a result, the ink ribbon can be reliably advanced and refreshed. Furthermore, while the range of print head movement is increased by step ST5, the position of the left edge Lp is not changed. As a result, the value of the left edge Lp of the print head movement range is the smaller of the current position CRp at which print head 23 is stopped and the left edge of the printing area set according to the print data in step ST1.

The value of the left edge of the printing area set according to this print data is specified by the upstream device outputting the print data, and is assumed to be a position within the printable area of the currently loaded recording media. As a result, when print head 23 travels through the range of print head movement thus defined, mask plate 40 will not move outside the limit of the recording media currently loaded to the printer. As a result, interference between the mask plate and the recording media can be expected to be prevented.

Based on the range of print head movement thus defined, it is determined in step ST6 whether the current stopped position CRp of print head 23 is closer to the left edge Lp or right edge Rp of the print head movement range. If print head 23 is closer to the right edge Rp, the current travel direction CTD of the print head is set to the left side, the print head movement starting position Sp is set to the right edge Rp, and the end position Ep of print head movement is set to the left edge Lp, in step ST7.

If in step ST6 it is determined that the current stopped position CRp of print head 23 is closer to the left edge Lp, the current travel direction CTD of the print head is set to the right side, the print head movement starting position Sp is set to the left edge Lp, and the end position Ep is set to the right edge Rp, in step ST8.

Print head 23 is then driven and printing is accomplished in step ST10 based on the print data. If the current stopped position CRp of print head 23 is within the range of print head movement, print head 23 must be moved to the print head movement starting position Sp at the right or left side of the movement area. To accomplish this, the current stopped position CRp of print head 23 is determined in steps ST11 and ST12, and in step ST13 print head 23 is moved to the print head movement starting position Sp. Printing is then executed in step ST14. When the one line is completely printed, the procedure loops back to step ST1, and the area required to print the next line is set.

As a result of the control method applied in a printer 1 according to the present embodiment above, mask plate 40 will not move outside the edges of the currently loaded recording media irrespective of the width of recording media used. In addition, there will be no interference between the sides of mask plate 40 and the recording media, and such problems as the recording media becoming jammed in the platen gap, or print head 23 becoming jammed, can be prevented. Furthermore, even if the printer itself does not detect the width of the recording media loaded into the printer, it is not necessary to determine the type of recording media by means of a paper width detector or other detection means because the range of print head movement is determined to assure the minimum travel required for ink ribbon refreshing within the boundaries of the recording media.

Therefore, the ink ribbon can be reliably advanced, and quality printing can be accomplished, without adding a new detection function to the printer and without paper jamming or other problems occurring when recording media of different widths is used. It is also not necessary to inform the printer of the type of recording media used when the print data is input to the printer from an upstream device. As a result, there is no possibility of the printer receiving the wrong recording media width information from a detection mechanism or upstream device, and problems caused by interference between mask plate 40 and the recording media can be prevented.

A compact printer capable of handling recording media of various widths with no problems can be achieved by applying the control method of the present invention as described above.

The control method of the present invention is described in further detail below with reference to a sample printing process.

In the following example, it is assumed that data to be printed in the range between left edge Lp and right edge Rp in FIG. 3 is received by printer 1 with print head 23 stopped near the left edge of validation form 12. Because current stepped position CRp is located to the left of the left edge Lp of the print head movement range defined according to the area to be printed, the print head movement range will be the range from the current position CRp to the right edge Rp. Note, also, that the minimum required travel MCT can be obtained between the current stopped position CRp and Rmax, but cannot be obtained between the current stopped position CRp and the right edge Rp. It is therefore necessary to offset the right edge Rp to a position Rp' corresponding to the current stopped position CRp plus the minimum required travel MCT. If print head 23 is driven using the current stopped position CRp as the starting position Sp and the new Rp' as the end position Ep, print head 23 will cover the area to be printed while also achieving the minimum travel MCT required to refresh the ink ribbon. In addition, print head 23 does not move farther left from the current stopped position CRp, and therefore does not move outside the area of validation form 12.

It should be noted that the above control process is premised upon expanding the print head movement range to the right when the required printing area is narrower than the range of carriage unit movement required to refresh the ink ribbon. For example, when the initial movement range, i.e., the difference between right edge Rp and left edge Lp obtained in step ST1, is smaller than the minimum required travel MCT, the movement range is expanded to the right by increasing the value of the right edge Rp in step ST5. This restriction on the direction in which the movement range can be expanded is required because the right side of mask plate 40 may move beyond the left side of the validation form when the carriage unit is moved beyond the left edge Lp obtained in step ST1, and this can be prevented by expanding the movement range only to the right.

It is possible, however, by means of the control method described below in the second embodiment of the invention to relax this directional restriction by using the history of the left edge Lp values of the movement range set each line to set the smallest Lp value set during printing to the currently loaded recording media as the left limit $L_{lim}$ of the movement range.

Figure 6:
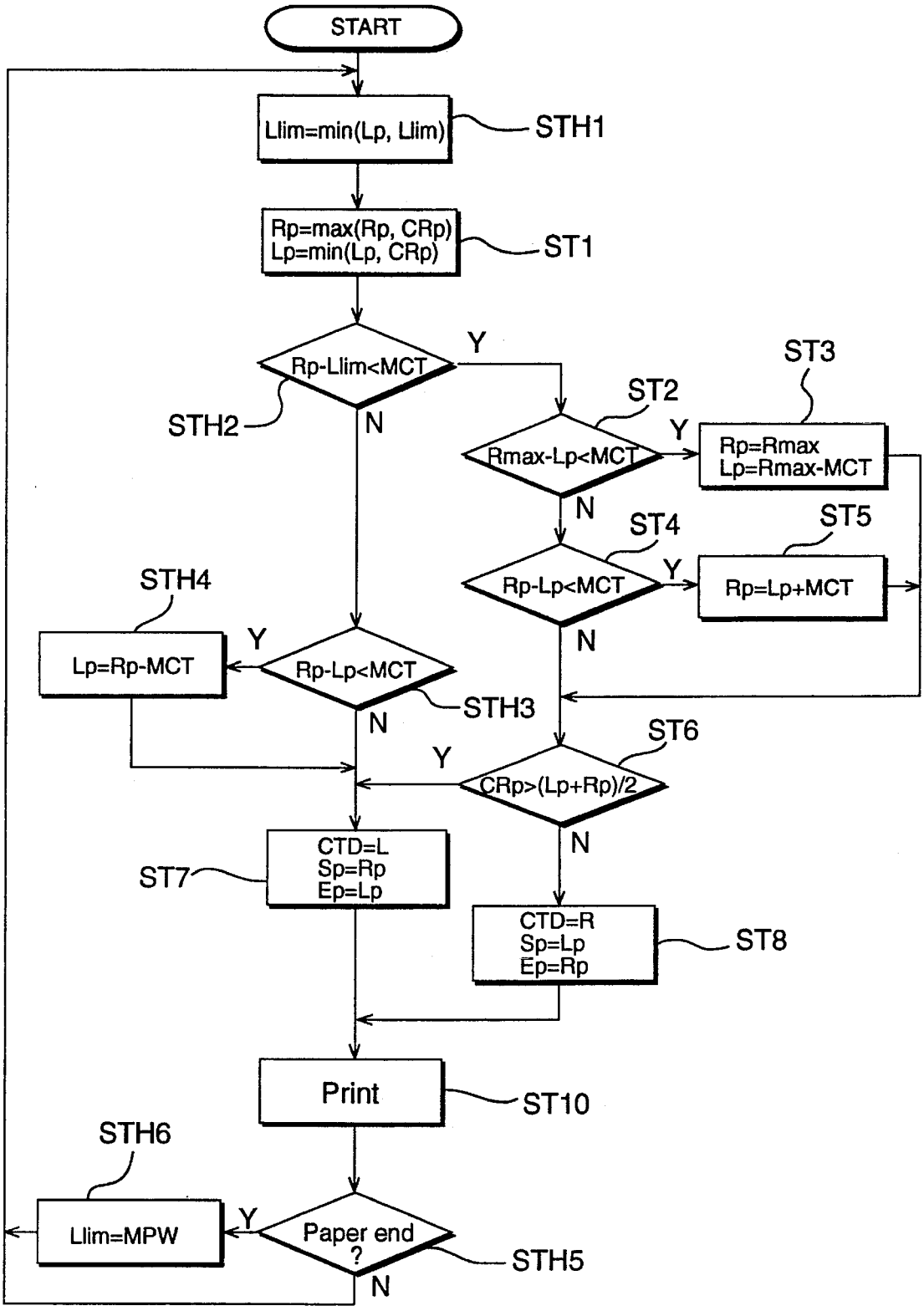
FIG. 6 is a flow chart of a second control method associated with ink ribbon advancement in the printer shown in FIG. 1.

FIG. 6 is a flow chart of the control method according to this second embodiment of the invention. Like control steps in the first control method described above with reference to FIG. 5 and the second control method shown in FIG. 6 are identified with like reference numbers.

In step STH1, the left edge Lp of the printing range defined for the current line is compared with the left limit $L_{lim}$ of the movement range, and the smaller value, i.e., the value for the position farthest left, is defined as the new left limit $L_{lim}$. By thus dynamically updating the value of the left limit $L_{lim}$, the left limit $L_{lim}$ can be set to the leftmost printing position during the current printing process.

As in the first control method described above, the print head movement range is set based on the right Rp and left edge Lp values of the area to be printed and the current position CRp of the carriage unit set in step ST1. In step STH2, the minimum required travel MCT is then compared with the distance between the left limit $L_{lim}$ and the right edge Rp of print head movement. If said distance is less than the minimum required travel MCT, the procedure steps to step ST2, and the process executed in the first control method above is executed.

If, however, said distance is greater than or equal to the minimum required travel MCT, the movement range and the minimum required travel MCT are compared in step STH3. If the movement range is smaller than the minimum required travel MCT, the value of the left edge Lp is corrected in step STH4 such that the distance between the left edge Lp and the right edge Rp is equal to the minimum required travel MCT, and control flows to step ST7. Note that this step corresponds to the correction of the right edge Rp of the movement range in step ST5 of the first control method.

If the movement range is greater than or equal to the minimum required travel MCT in step STH3, control flows to step ST7. As a result, the direction of print head movement is set to LEFT; the print head movement starting position Sp is set to the right edge Rp; and the end position Ep is set to the left edge Lp.

After printing in step ST10, it is determined in step STH5 whether all printing to the current recording media is completed, i.e., whether the end of the recording media has been detected.

If the end of the recording media has been detected, the left limit $L_{lim}$ is initialized in step STH6 to the left-side range limit MPW, which is set according to the narrowest recording media usable with the printer. As a result, even if the next printing operation applies to the narrowest recording media usable in the printer, mask plate 40 will be prevented from moving beyond the left edge of the recording media.

If the end of the recording media has not been detected in step STH5, the current value of the left limit $L_{lim}$ is held, and the process loops back to step STH1.

Because the range of allowable movement of print head 23 can be expanded by means of this second control method of the invention, the number of times the direction of print head movement is changed is reduced, and the print head can be moved more smoothly. In other words, printing processes in which the print head must be moved the minimum required travel MCT to the right after moving to the left edge Lp when the first control method is used can, by applying this second control method, be accomplished by simply moving the print head from the current position CRp further left to a point between the left limit $L_{lim}$ and the left edge Lp. This is described below.

When the current position CRp is between the fight edge Rp of the printing area and $R_{max}$, the distance between the current position CRp and the left limit $L_{lim}$ will be greater than the minimum required travel MCT, and the distance between the current position CRp and the left edge Lp will be less than MCT. With the first control method above, the fight edge Rp is set to CRp and the left edge Lp is set to the left edge Lp of the printing area in the first step ST1. If under these conditions the distance between the right edge Rp and the left edge Lp of the printing area is shorter than the minimum required travel MCT, and the distance between the left edge Lp and $R_{max}$ is greater than MCT, control flows in the flow chart in FIG. 5 from step ST4 to step ST5, and the value of the right edge Rp is corrected. The resulting right edge Rp and left edge Lp values are thus:

Rp=Lp+MCT

Lp=Lp.

Control then flows through step ST6 to step ST7 or ST8, and the resulting values for the direction, starting position, and end position of print head movement are:

$$CTD = L \quad Sp = Lp + MCT \quad Ep = Lp \tag{2}$$

as a result of step ST7, or $$CTD = R \quad Sp = Lp \quad Ep = Lp + MCT \tag{3}$$

as a result of step ST8.

In each of these cases (ST7 and ST8), it is necessary to reassess the movement of the print head during the printing process of step ST10. When control flows through step ST7, CRp and Sp are compared in step ST12. Because the distance between the current position CRp and the left edge Lp is less than MCT under the above conditions, CRp–Lp<MCT, and by substituting equation (2) above, CRp>Sp.

The conditions of step ST12 are therefore satisfied, and in step ST13 the print head is moved to the print head movement starting position Sp.

When control flows through step ST8, CRp and Sp are compared in step ST 11. Because CRp is clearly to the right of Lp under the above conditions, CRp>Lp, and by substituting equation (3) above, CRp>Sp.

The conditions of step ST11 are therefore satisfied, and the print head is again moved to the print head movement starting position Sp in step ST13.

When the distance between $R_{max}$ and printing area left edge Lp is shorter than the minimum required travel MCT, i.e., when $$R_{max}\text{–}Lp<MCT \tag{4}$$

is true as determined by step ST2, control steps to step ST3 whereby the right edge Rp and left edge Lp of the movement range are defined as follows:

$Rp=R_{max}$ $Lp=R_{max}$–MCT.

In these cases, the direction of print head mask plate CTD during printing, the print head movement starting position Sp, and the end position Ep are set as follows in step ST7 or ST8:

CTD=L $Sp=R_{max}$ $Ep=R_{max}$–MCT as a result of step ST7, or

CTD=R $Sp=R_{max}$–MCT $Ep=R_{max}$ as a result of step ST8.

Because CRp is clearly to the right of Lp under the above conditions,

CRp>Lp, and by substituting equation (4) above, CRp>$R_{max}$–MCT.

Thus, when the direction of print head movement is set in step ST8 to be RIGHT, the conditions of step ST11 are satisfied, and the print head is moved to the print head movement starting position Sp in step ST13.

In addition, because the current position CRp is to the left of the farthest right edge position $R_{max}$, CRp<$R_{max}$.

As a result, when the direction of print head movement is set in step ST7 to be LEFT, the conditions of step ST12 are satisfied, and the print head is again moved to the print head movement starting position Sp in step ST13.

As described above, the print head is first moved to the print head movement starting position Sp, and is then moved in the opposite direction for printing under the above conditions.

Operation under the same conditions as above controlled by the second control method of the invention is described below. Under these conditions, the current position CRp is to the right of the right edge Rp of the printing area, and the current position CRp value is therefore set to the right edge Rp value in step ST1:

$$Rp=CRp. \tag{5}$$

Because the distance between the left limit $L_{lim}$ and the current position CRp is greater than the minimum required travel MCT under the above conditions, the equation in step STH2 is not satisfied, and control passes to step STH3. Because the distance between the current position CRp and Lp is shorter than the minimum required travel MCT under these conditions, the left edge Lp value is updated in step STH4 to (Rp–MCT). The other variables are therefore set as follows in step ST7:

CTD=L

Sp=Rp

Ep=Rp–MCT.

As a result, step ST12 in the printing process ST10 is not satisfied because of equation (5), and print head movement and printing are started directly from the current position CRp without executing the process whereby the print head is first moved to the print head movement starting position Sp.

Thus, in printers whereby acceleration and deceleration accompany print head movement, an extreme difference in the processing time occurs between the process whereby print head movement is interrupted to change the direction of travel while performing a single line printing, and the process whereby the print head is driven without changing the direction of travel while performing a single line printing. As a result, application of the second control method above in printers driving the print head with acceleration and deceleration thereof can achieve a significant improvement in printing speed.

If the additional movement required for acceleration and deceleration is included in the printing range when defining the printing range in a printer driving the print head with acceleration and deceleration thereof, either the first or second control method above can be applied without modification.

Figure 7:
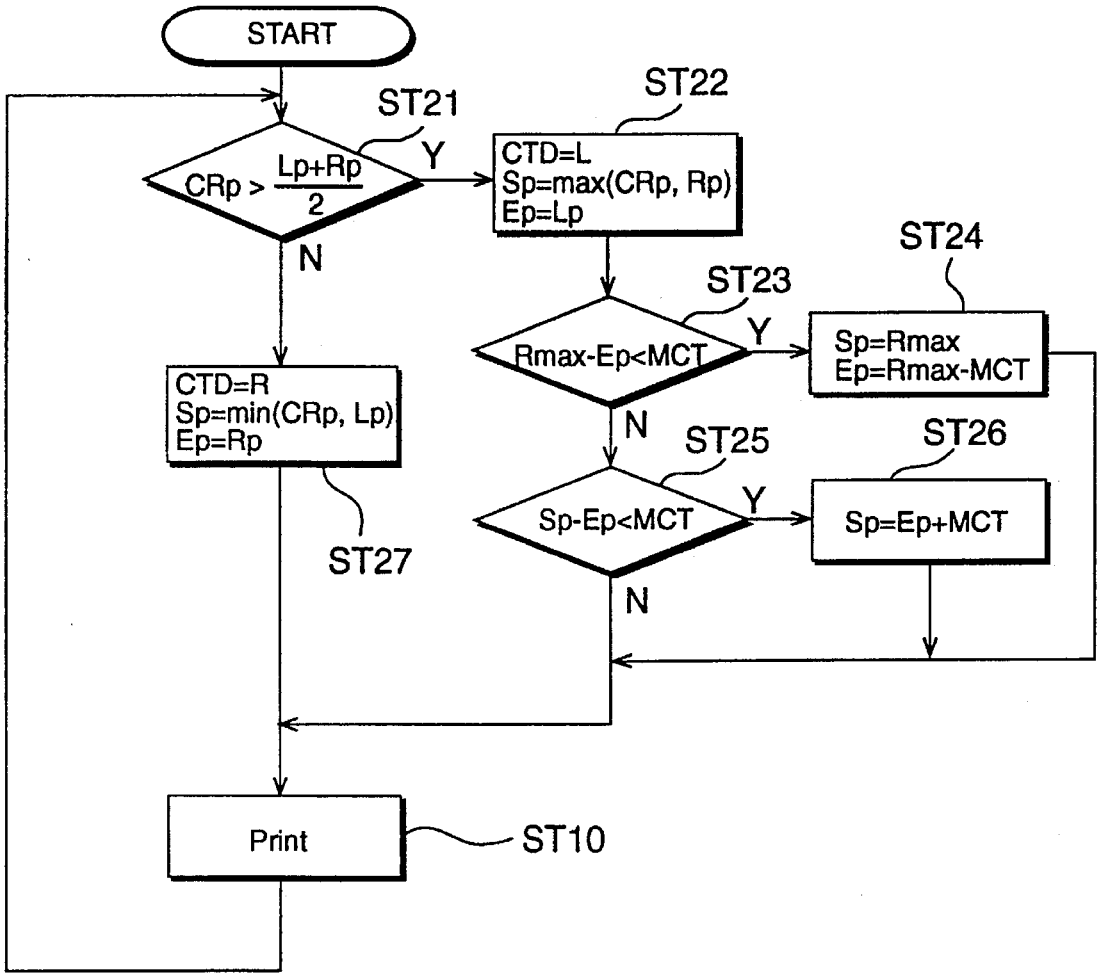
FIG. 7 is a flow chart of an alternative control method associated with ink ribbon advancement in the printer shown in FIG. 1.

FIG. 7 is a flow chart of the control method applied in a printer using a mechanism whereby the ink ribbon is advanced only when the print head moves from the right side 2*b* to the left side 2*a* of the printer. A mechanism of this type also makes it possible to reduce the load on the drive motor by reducing the number of gears in the ink ribbon advancing mechanism, and also makes it possible to thereby reduce the number of parts. A mechanism of this type can be achieved by, for example, removing rocker gear 73*a* and idler gear 74 in ink ribbon transport assembly 70 shown in FIG. 3.

The first step in the control method applied with this mechanism is to determine the direction of print head movement in step ST21. Specifically, if the current position CRp at which the print head is stopped is near the left edge Lp of the area to be printed, the direction of print head movement is determined to be LEFT, and is otherwise determined to be RIGHT. If print head 23 is moved toward the left, the process executed from step ST2 to step ST5 in FIG. 5 above is executed from step ST22 to step ST26 in FIG. 7. In this case, the right edge Rp of the print head 23 movement range is defined as the print head movement starting position Sp, and the left edge Lp is defined as the end position Ep. If the print head is moved to the right, it is not necessary to advance the ink ribbon, and the print head movement range is defined as shown in step ST27.

Specifically, the starting position Sp is defined as the left edge Lp of the movement range or the current position CRp, whichever is farther left; the right edge Rp of the movement range is defined as the end position Ep; and the current travel direction CTD is RIGHT. The print head is then controlled as described in the printing process (ST10) in FIG. 5 to print.

As will be obvious from the above description, the ink ribbon is not refreshed when the print head prints moving to the right. To compensate for this, the amount of ribbon advanced to refresh the ink ribbon when the ink ribbon is advanced only when the print head moves left must be increased to an amount corresponding to the amount of ribbon advanced by a mechanism that advances the ink ribbon during both right and left movement of the print head. To achieve this, the speed reduction ratio of ink ribbon transport assembly 70 can be reduced, or the minimum required travel MCT can be increased, to increase ink ribbon advancement.

Figure 8:
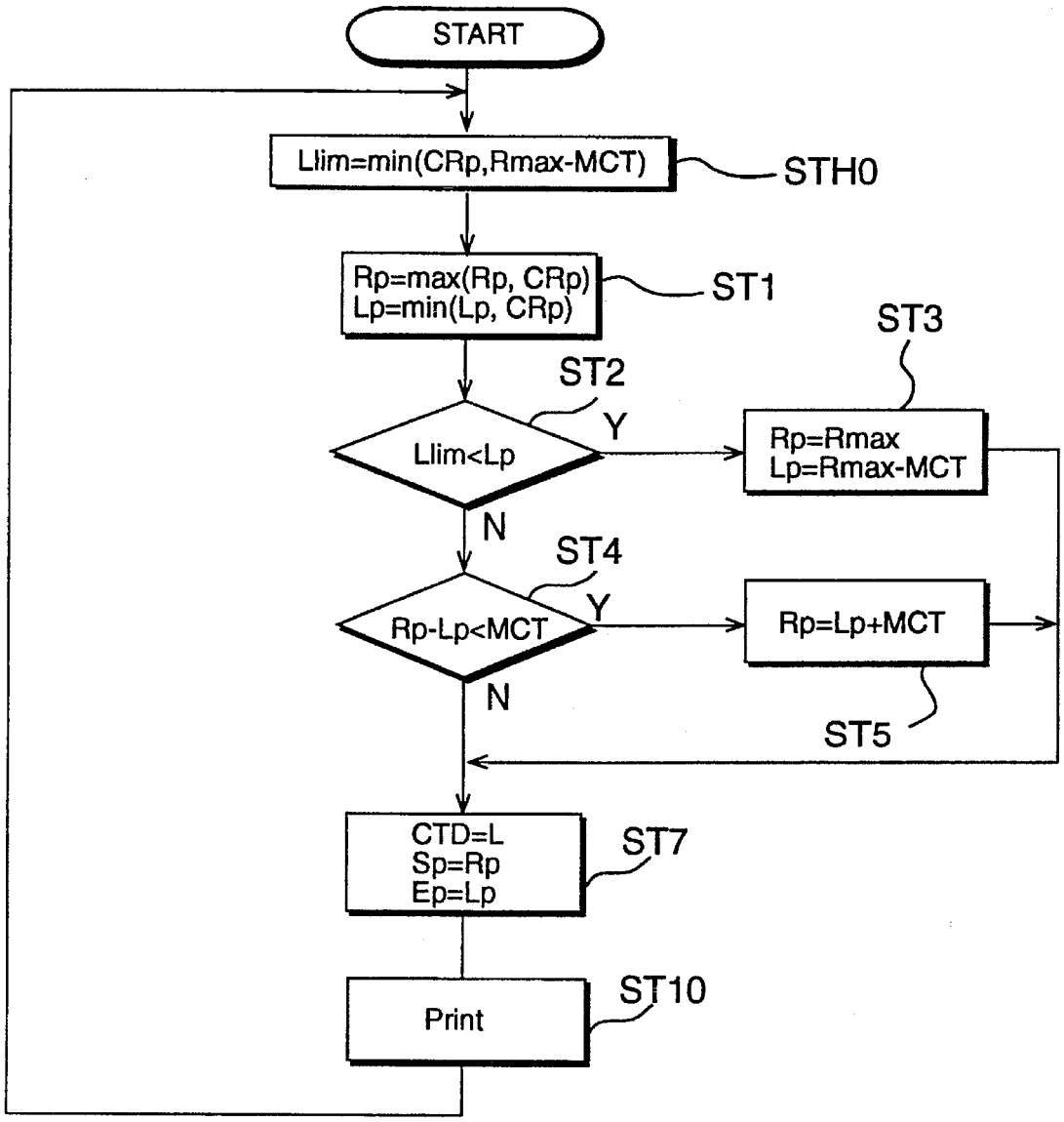
FIG. 8 is a flow chart of an alternative version of the control method associated with ink ribbon advancement shown in FIG. 7.

The first control method described above can be applied to print head movement control with this type of mechanism. In this case, the printing direction determined in step ST6 in FIG. 5 is fixed to LEFT irrespective of the other conditions. The ink ribbon will therefore be refreshed with the leftward movement of the print head in each print line. A flow chart of this control process is shown in FIG. 8.

Figure 9:
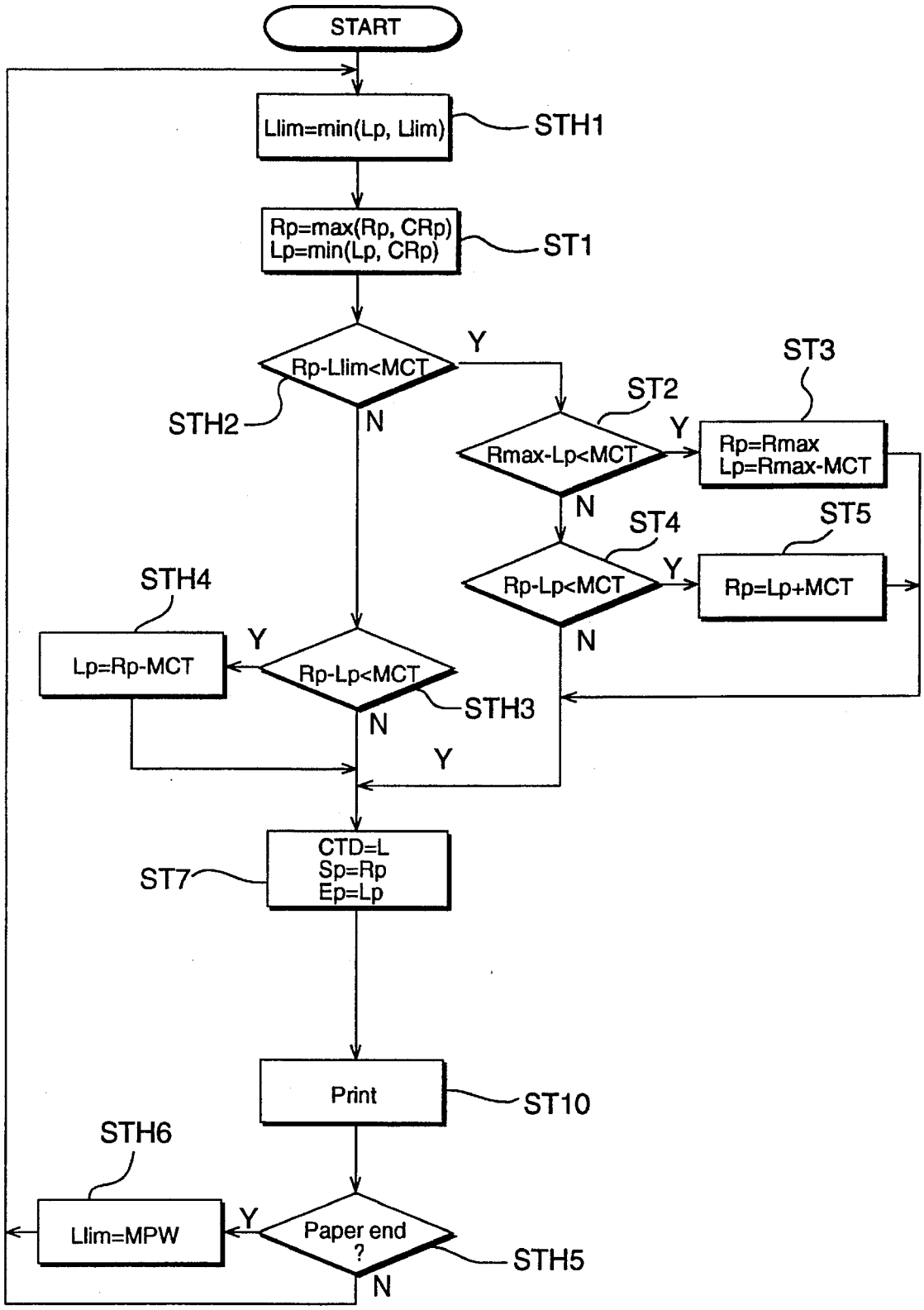
FIG. 9 is a flow chart of another alternative version of the control method associated with ink ribbon advancement shown in FIG. 7.

The second control method described above can also be applied to print head movement control with this type of mechanism. As with the first control method above, the printing direction determined in step ST6 in is fixed to LEFT irrespective of the other conditions. A flow chart of this control process is shown in FIG. 9.

Figure 10:
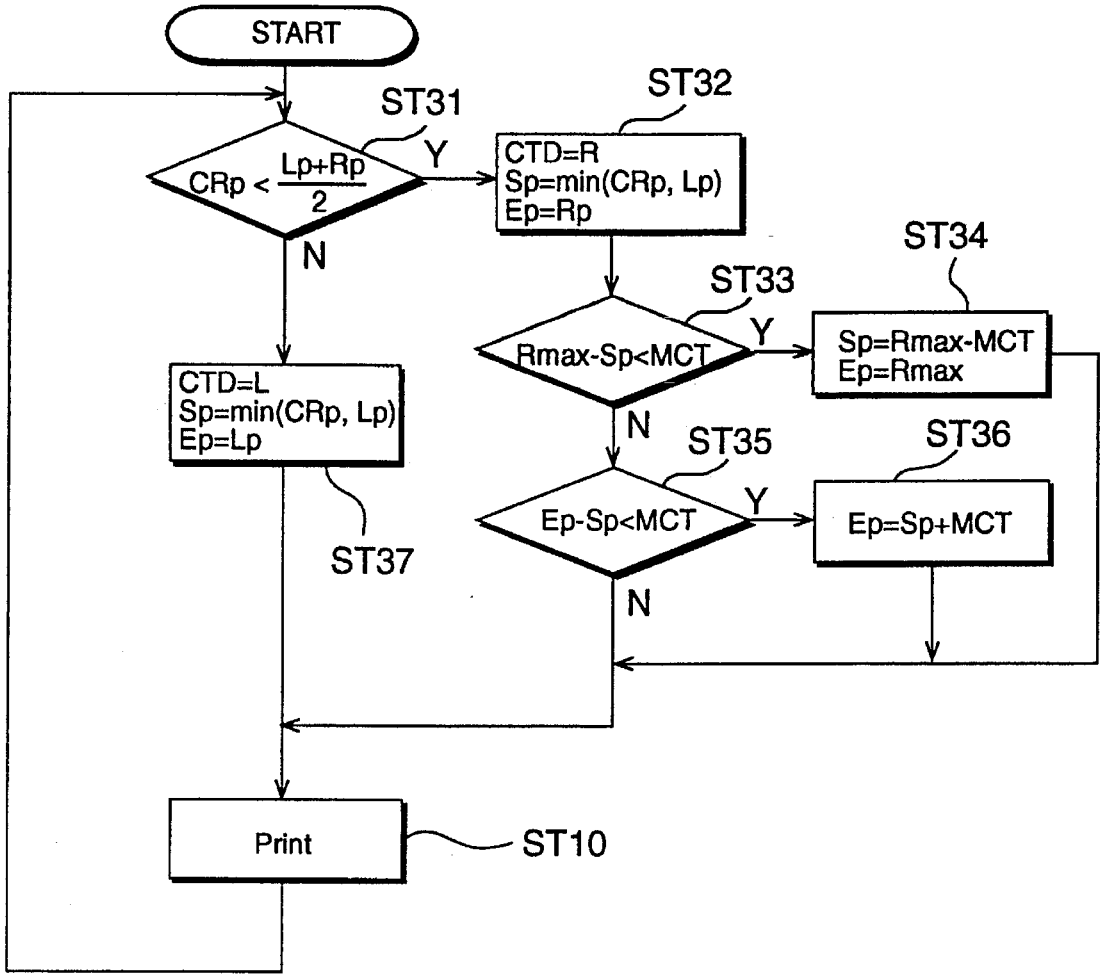
FIG. 10 is a flow chart of a control method associated with ink ribbon advancement according to a different embodiment of the invention.

FIG. 10 is a flow chart of the control method applied using a mechanism whereby the ink ribbon is advanced only when the print head moves from the right side 2*b* to the left side 2*a* of the printer. A mechanism of this type can be achieved by, for example, removing rocker gear 73*b* and idler gear 74 in ink ribbon transport assembly 70 shown in FIG. 3.

The first step in the control method applied with this mechanism is to determine the direction of print head movement in step ST31. If print head 23 is moved toward the right, the process executed from step ST2 to step ST5 in FIG. 5 above is executed from step ST32 to step ST36 in FIG. 10. In this case, the left edge Lp of the print head 23 movement range is defined as the print head movement starting position Sp, and the right edge Rp is defined as the end position Ep. If the print head is moved to the left, it is not necessary to advance the ink ribbon, and the print head movement range is defined as usual as shown in step ST37. The print head is then controlled as described in the printing process (ST10) in FIG. 5 to print.

Figure 11:
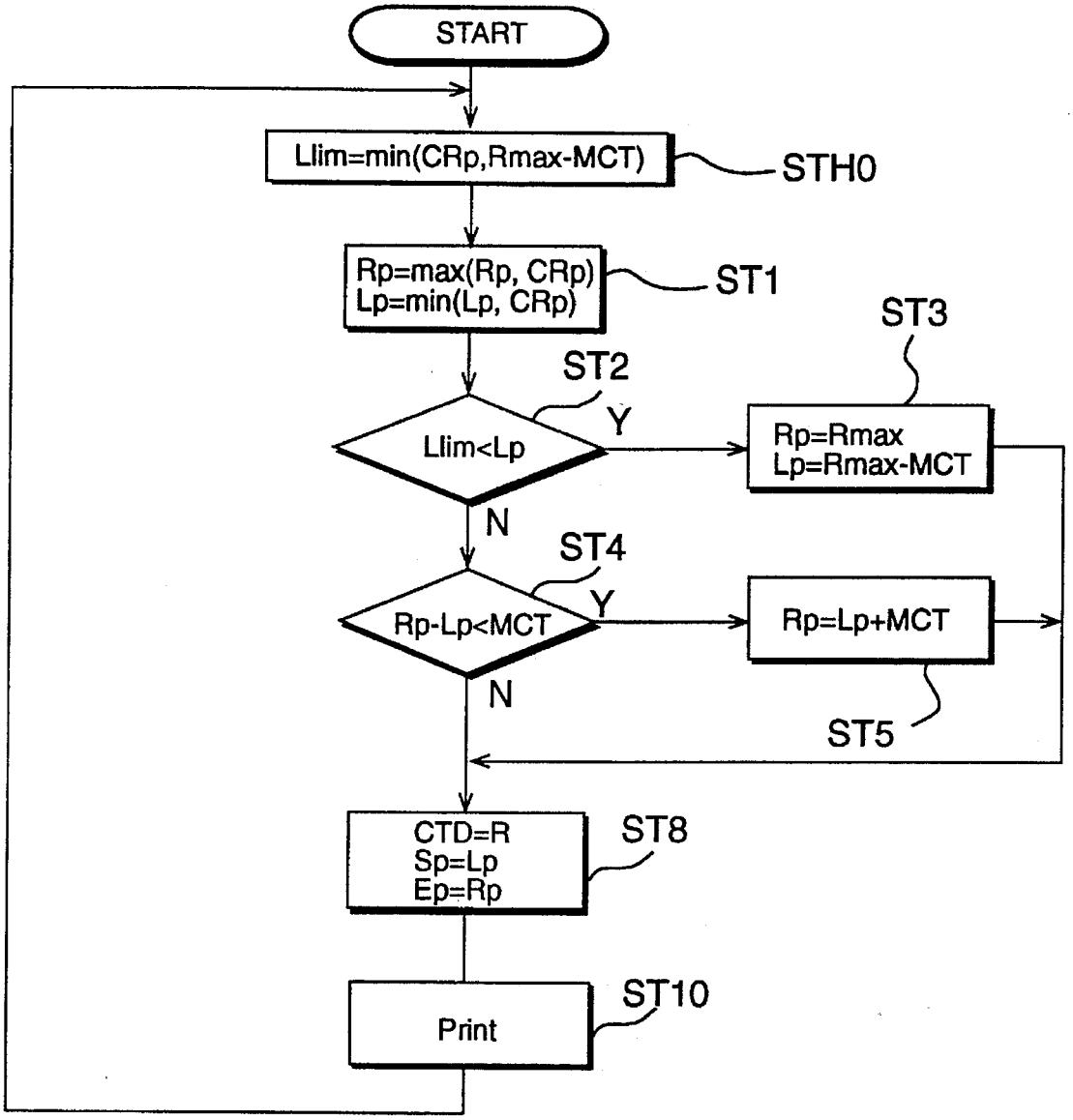
FIG. 11 is a flow chart of an alternative version of the control method associated with ink ribbon advancement shown in FIG. 10.

The first control method described above can be applied to print head movement control with this type of mechanism, and a flow chart of this control process is shown in FIG. 11. It is to be noted that the second control method is characterized by expanding the range of print head movement to the left, but application of this control method to a mechanism unable to advance the ink ribbon while moving to the left is essentially meaningless, and the benefit normally derived from this second control method cannot be achieved.

By thus applying a control method as described above to a printer using a mechanism whereby the ink ribbon is advanced only when the print head moves in one direction, interference between mask plate 40 and the recording media can be prevented, and high reliability printing can be achieved, even when recording media of different widths is used.

It is to be noted that because the recording media is inserted to the printer of the invention aligned to the right side, the range of print head movement is adjusted referenced to the right side of the printer, but it is also possible to use the left side as the reference depending upon the printer application. A control method for this left side reference can be easily derived from the control methods described herein above by interchanging the right and left sides in each step of the above control processes.

It will also be obvious that the printer may be comprised to detect by means of the paper detecting means when recording media with specifications differing from those of the roll paper is loaded into the printer, and to control printer operation accordingly as described above.

Figure 12:
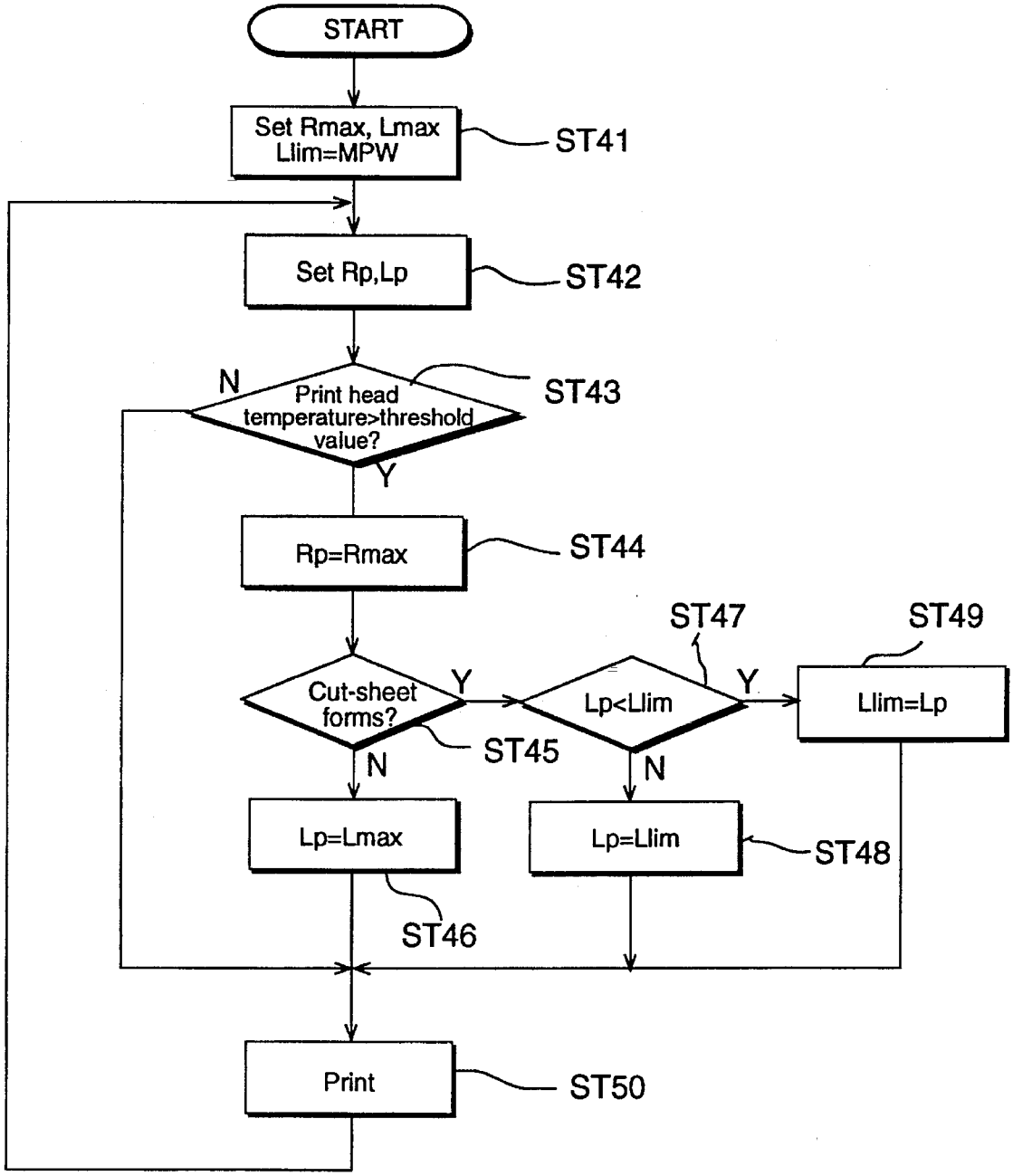
FIG. 12 is a flow chart of a control method associated with the cooling operation of the print head in the printer shown in FIG. 1.

FIG. 12 is a flow chart of the control method applied with a print head cooling mode, and is referenced in the below description of print head 23 operation in this cooling mode.

When printer 1 is reset, the $R_{max}$ and $L_{max}$ values defining the maximum limit of the area printable by print head 23 are defined, and the left limit $L_{lim}$ is defined as the left-side range limit MPW for the narrowest validation form that may be printed using printer 1 (step ST41).

In step ST42, the right edge Rp and left edge Lp of the area through which print head 23 moves are initialized to the right and left edges, respectively, of the area to be printed based on the print data contained in internal data 61.

In step ST43, operating mode controller 57 determines whether the temperature of print head 23 is greater than the predetermined threshold value. If the print head 23 temperature has not risen to this threshold value, control jumps to the printing process of step ST50. The printing process of step ST50 may be either the first control method shown in FIG. 5, or the second control method shown in FIG. 6. It should be noted, however, that the control step to which the printing process loops back when printing is completed is step ST42 in FIG. 12.

If in step ST43 the temperature of print head 23 is greater than the predetermined threshold value, the right edge Rp value of the print head movement range is changed to $R_{max}$ in step ST44. It is then determined in step ST45 whether cut-sheet type recording media is selected. In printer 1 according to the present embodiment, paper detector 55 determines whether cut-sheet forms or roll paper is required based on internal data 61.

If the recording media is roll paper 11, the left edge Lp value of the print head movement range is set to $L_{max}$ in step ST46. By thus redefining the left edge Lp and right edge Rp of the print head movement range to $L_{max}$ and $R_{max}$, respectively, the printing area defined according to internal data 61 is exceeded, and print head 23 moves through the largest possible printable area. The print duty of print head 23 therefore drops, and the temperature increase thereof can be suppressed.

If, however, cut-sheet type recording media is selected, step ST45 branches to step ST47 to compare the left limit $L_{lim}$ value with the left edge Lp value. If Lp is greater then $L_{lim}$, i.e., if the left edge of the printing area is to the right of the left limit of print head movement, the left edge Lp of print head movement is changed to the left limit $L_{lim}$. As a result, print head 23 exceeds the printing area, and prints while moving between the $R_{max}$ position and the left limit $L_{lim}$ position. It is therefore possible to prevent interference between mask plate 40 moving with print head 23 and the recording media, reduce the print duty of print head 23, and thereby suppress the temperature rise in the print head.

If in step ST47 left edge Lp is less than the left limit $L_{lim}$, i.e., if the left edge of the printing area is to the left of the left limit of print head movement, the value of left edge Lp is not changed. In this case, the left limit $L_{lim}$ value is redefined to the value of left edge Lp in step ST49. If printing to a position beyond the left limit $L_{lim}$ is required based on internal data 61 input to printer 1, it can be assumed that the width of the recording media currently loaded into printer 1 is greater than the width corresponding to the current left limit $L_{lim}$ value. As a result, print head 23 will not move beyond the recording media edge if the left limit $L_{lim}$ of the print head is expanded.

Because the recording media is loaded with the right edge of the recording media aligned to the right side of the insertion opening of printer 1 in the present embodiment, the right edge Rp value can be expanded to $R_{max}$. For example, if in FIG. 2 slip forms 13 printing is selected, print head 23 first moves between $R_{max}$ and left-side range limit MPW defined for the narrowest form printable by the printer. When the left edge Lp value is set to L1 based on the print data, the left limit $L_{lim}$ for that recording media will be L1, and the range of allowable movement for print head 23 increases. By thus increasing the minimum range of allowable movement for print head 23, the print duty can be further reduced, the temperature rise in the print head suppressed, and the temperature can be lowered.

When narrow recording media that may be narrower than the maximum range of allowable movement defined by $R_{max}$ and $L_{max}$ is selected in a printer according the present embodiment, the first control step is to define the value for left-side range limit MPW according to the narrowest recording media usable, and thereby prevent mask plate 40 from separating from the recording media. Based on the print data received thereafter, the print head movement range is expanded within the range whereby mask plate 40 does not separate from the recording media, thereby efficiently suppressing the increase in the print head temperature.

By means of the printer control method thus described, mask plate 40 will not move outside the area of the recording media even when the narrowest paper printable by the printer 1s used. There is therefore no interference between mask plate 40 and the recording media, and recording media damage and print head jamming problems resulting therefrom can be prevented. The print head movement range is also set according to the narrowest paper width while the range of print head movement may be expanded based on the print data.

It is therefore not necessary for the user to manually specify the required paper width even when the range of print head movement is expanded within the range wherein the above interference-related problems do not occur as a means of efficiently controlling the increase in print head temperature. It is also not necessary to supply the paper width information from the personal computer or other external device supplying the print data to the printer.

It is also not necessary to provide plural paper detectors to detect the paper width, and the complex control methods required to change the print head movement range according to the actual paper width are not required.

It is therefore possible to reliably control the print head temperature by means of a mechanism of simple construction without causing problems related to paper or print head jamming even when using different types and widths of recording media by applying a printer control method according to the present invention thus described.

It is to be noted that a printer according to the present invention changes the print duty by controlling the range of print head movement. When it is not possible to suppress the temperature rise by changing the range of print head movement and the temperature continues to rise, it is simple to insert a predetermined interval into print head movement to further reduce the print duty.

Moreover, because the recording media is loaded to the printer of the invention aligned to the right side of the insertion opening, the range of print head movement is changed referenced to this right side of the printer. It will be obvious, however, that this reference position may be the left side of the printer or even the center of the printer.

Furthermore, the recording media is evaluated in step ST45 in this embodiment, but this step may be eliminated and the control method modified to assume printing to cut-sheet type forms. In this case, no paper width information is required of any kind, and the exchange of data between the printer and external devices can be further simplified. The cooling efficiency may drop slightly in this case when printing to roll paper, however, because the print head cooling operation may be executed in an area narrower than the maximum print head movement range.

As described herein above, a printing apparatus according to the present invention can assure the minimum amount of print head travel required to advance the ink ribbon using recording media, including slip forms, validation forms, and other forms, of different widths without detecting the paper width. It is therefore not necessary to add to the printing apparatus any means of monitoring the width of the different forms, and it is not necessary to request from the upstream device information relating to the type of recording media used.

It is therefore possible for a printing apparatus according to the present invention to prevent, by means of a simple mechanical configuration and a simple control method, interference between the recording media and the mask plate or other recording media pressing means moving with the print head even when recording media of different widths is used because the print head never moves outside the area of the loaded slip form or other printing form. As a result, small recording media of various types can be used without problems in a printing apparatus of the present invention, and a quiet, high reliability printing apparatus using a mask plate to prevent interference with the ink ribbon can be achieved.

When validation forms or another type of slip form is selected, a printing apparatus according to the present invention first sets the range of print head movement to the smallest range limit, and then expands the range of print head movement based on the area to be printed. As a result, even when the range of print head movement is expanded to prevent the print head from heating above a predetermined threshold value, the mask plate will not move beyond the range of the validation form or other slip form, and interference between the recording media and the mask plate or other recording media pressing means moving with the print head can be prevented. Therefore, the reliability of a printing apparatus that is capable of using small recording media of various types and achieves quiet, high reliability operation using a mask plate to prevent interference with the ink ribbon can be further improved.

A printing apparatus according to the present invention can prevent interference between the mask plate and the recording media by means of a simple mechanical configuration and a simple control method, and is therefore readily applicable in compact, lightweight, multiple function printing apparatuses.

What is claimed:

1. A printing apparatus for printing on a recording medium within a predetermined printing range, comprising:

a platen;

a print head;

receiving means for receiving a recording medium, said receiving means having one predetermined side guiding one side of the recording medium for positioning the recording medium;

range determination means for determining a current movement range of said print head in accordance with print data supplied from a host system;

range limit storing means for storing a movement range limit of said print head which is defined with reference to said predetermined side of said receiving means and is smaller than the predetermined printing range;

masking means, disposed between said print head and the recording medium, for pressing the recording medium against said platen, said masking means moving with said print head within the movement range limit of said print head; and range expansion means for selectively expanding the current movement range of said print head within the movement range limit of said print head.

2. The printing apparatus according to claim 1, wherein said range limit storing means stores the movement range limit corresponding to a narrowest width of the recording medium to be used in the printing apparatus.

3. The printing apparatus according to claim 1, further comprising:

width determination means for determining a width of the recording medium based on information received from the host system;

wherein said range limit storing means stores the movement range limit corresponding to the width determined by said width determination means.

4. The printing apparatus according to claim 1, further comprising:

range comparing means for comparing the current movement range of said print head with the movement range limit of said print head stored in said range limit storing means; and updating means for updating the movement range limit of said print head by storing a wider one of the current movement range and the movement range limit of said print head to said range limit storing means in accordance with a comparison result output from said range comparing means.

5. The printing apparatus according to claim 4, further comprising:

a recording medium detector for detecting a presence of the recording medium;

wherein said range limit updating means stores a predetermined initial movement range limit of said print head to said range limit storing means based on a detection result output from said recording medium detector.

6. The printing apparatus according to claim 1, further comprising:

an ink ribbon disposed between said print head and said masking means;

ink ribbon advancing means for advancing said ink ribbon in conjunction with print head movement;

movement amount comparing means for comparing an amount of print head movement with a predetermined amount of print head movement required to sufficiently advance said ink ribbon;

wherein said range expansion means expands the current movement range of said print head to achieve the predetermined amount of print head movement based on a comparison result output from said movement amount comparing means.

7. The printing apparatus according to claim 6, further comprising:

direction evaluation means for determining a direction of the print head movement based on the current movement range of said print head and a position of said print head;

wherein said ink ribbon advancing means advances said ink ribbon only when the direction of the print head movement determined by said direction evaluation means is one direction; and said range expansion means expands the current movement range of said print head only when the direction of the print head movement determined by said direction evaluation means is said one direction.

8. The printing apparatus according to claim 1, further comprising:

temperature detecting means for detecting a temperature of said print head; and temperature rise detecting means for comparing the temperature of said print head with a predetermined threshold value;

wherein said range expansion means expands the current movement range of said print head when a temperature rise is detected by said temperature rise detecting means.

9. The printing apparatus according to claim 8, wherein said range expansion means expands the current movement range of said print head to the movement range limit of said print head.

10. A control method for a printing apparatus which prints on a printing medium within a predetermined printing range, the printing apparatus comprising a platen, a print head, receiving means for receiving a recording medium, the receiving means having one predetermined side guiding one side of the recording medium, and masking means disposed between the print head and the recording medium for pressing the recording medium against the platen, the masking means moving with the print head, the method comprising the steps off:

determining a current movement range of the print head in accordance with print data supplied from a host system;

storing a movement range limit of the print head which is defined with reference to the predetermined side of the receiving means and is smaller than the predetermined printing range, the movement range limit of the print head representing a narrowest width of the recording medium for use with the printing apparatus;

controlling the masking means to move with the print head within the movement range limit of the print head; and selectively expanding the current movement range of the print head within the movement range limit of the print head.

11. The control method according to claim 10, further comprising the steps of:

comparing the current movement range of the print head with the movement range limit of the print head; and updating the movement range limit with a wider one of the current movement range and the movement range limit of the print head based on a comparison result from said comparing step.

12. The control method according to claim 11, further comprising the step of:

detecting a presence of recording medium;

wherein said storing step stores the movement range limit based on a change in a detection result from said detecting step.

13. The control method according to claim 11, further comprising the step of:

determining a width of an inserted recording medium based on information received from the host system;

wherein said storing step stores the movement range limit of the print head corresponding to the width of the recording medium determined in said determining step.

14. The control method according to claim 11, further comprising the steps of:

advancing an ink ribbon disposed between the print head and the masking means in conjunction with movement of the print head; and comparing an amount of print head movement with a predetermined amount of print head movement required to sufficiently advance the ink ribbon;

wherein said expanding step expands the current movement range of the print head to achieve the predetermined amount of print head movement when the amount of print head movement is less than the predetermined amount of the print head movement.

15. The control method according to claim 14, further comprising the step of:

determining a direction of print head movement based on the current movement range of the print head and a position of the print head;

wherein said advancing step advances the ink ribbon only when the direction determined in said direction determining step is one direction; and wherein said expanding step expands the current movement range of the print head only when the direction determined in said direction determining step is said one direction.

16. The control method according to claim 11, further comprising the steps of:

detecting a temperature of the print head; and detecting whether the temperature of the print head exceeds a predetermined threshold value;

wherein said expanding step expands the current movement range of the print head when a temperature rise is detected in said temperature detecting step.

* * * * *

UNITED STATES PATENT AND TRADEMARK OFFICE

CERTIFICATE OF CORRECTION

| | | |
|---|---|---|
| PATENT NO. | : | 5,609,426 |
| DATED | : | March 11, 1997 |
| INVENTOR(S) | : | Yoshikazu Ito, et al. |

It is certified that an error appears in the above identified patent and that said Letters Patent is hereby corrected as shown below:

Column 25, line 6, change "off:" to --of:--.

Signed and Sealed this

Sixth Day of May, 1997

*Attest:*

Bruce Lehman

BRUCE LEHMAN

*Attesting Officer*

*Commissioner of Patents and Trademarks*